United States Patent [19]

Carstens

[11] 4,300,981

[45] Nov. 17, 1981

[54] LAYERED PAPER HAVING A SOFT AND SMOOTH VELUTINOUS SURFACE, AND METHOD OF MAKING SUCH PAPER

[75] Inventor: Jerry E. Carstens, Cincinnati, Ohio

[73] Assignee: The Procter & Gamble Company, Cincinnati, Ohio

[21] Appl. No.: 93,312

[22] Filed: Nov. 13, 1979

[51] Int. Cl.[3] ..... D21H 5/00; D21H 5/24

[52] U.S. Cl. ..... 162/109; 162/111; 162/112; 162/113; 162/130; 162/131; 162/132; 428/153; 428/154

[58] Field of Search ..... 162/111-113, 162/115, 123, 125, 129, 130, 131, 132, 133, 204, 109; 428/154, 153, 91, 97; 264/282, 283, 284

[56] References Cited

U.S. PATENT DOCUMENTS 3,203,850 8/1965 McCarty ..... 264/283
3,994,771 11/1976 Morgan et al. ..... 162/113

FOREIGN PATENT DOCUMENTS 526305 6/1956 Canada ..... 428/154

*Primary Examiner*—Peter Chin

*Attorney, Agent, or Firm*—Thomas J. Slone; Fredrick H. Braun; Richard C. Witte

[57] ABSTRACT

A layered paper and method of making it, which paper is characterized by having a soft, relatively untextured smooth velutinous surface defined by a multiplicity of relatively flaccid papermaking fibers having unbonded free end portions of substantial length, and which surface is subjectively discernible by humans as being extremely soft and smooth. Exemplary embodiments include tissue paper, and tissue paper products comprising one or more plies of such paper. The method includes wet laying a layered web which has a relatively low bond surface layer comprising at least about 60% relatively short papermaking fibers, drying the web without imparting substantial texture thereto, breaking sufficient papermaking bonds in the surface layer to generate a velutinous surface having an FFE-Index of at least about 60 and preferably at least about 90, and calendering the dried web as required to provide said surface layer with an HTR-Texture of about 1.0 or less, and more preferably about 0.7 or less, and most preferably about 0.1 or less.

31 Claims, 60 Drawing Figures

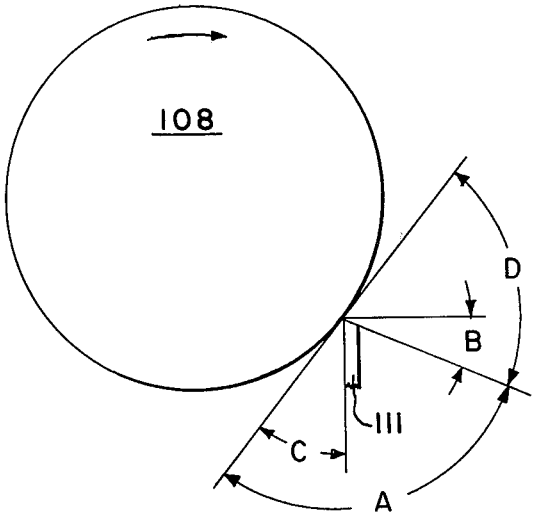
Fig. 19
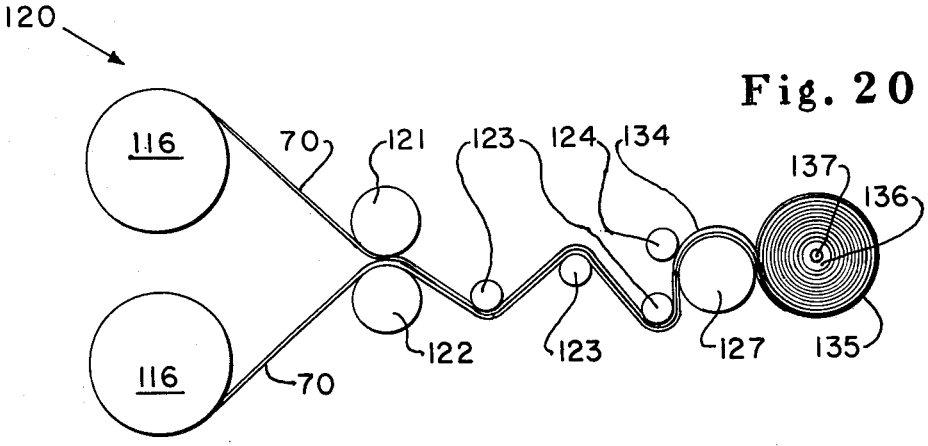
Fig. 20
Fig. 21
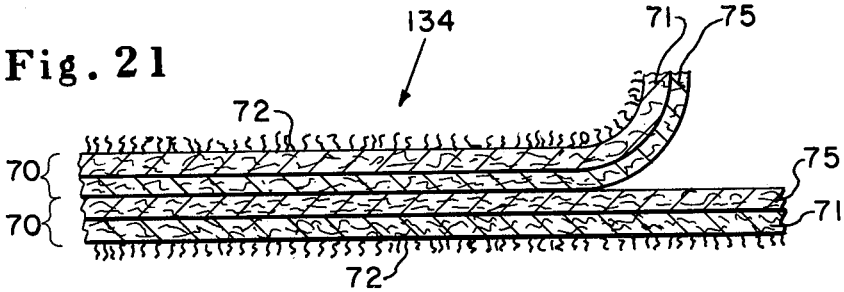

Fig. 24
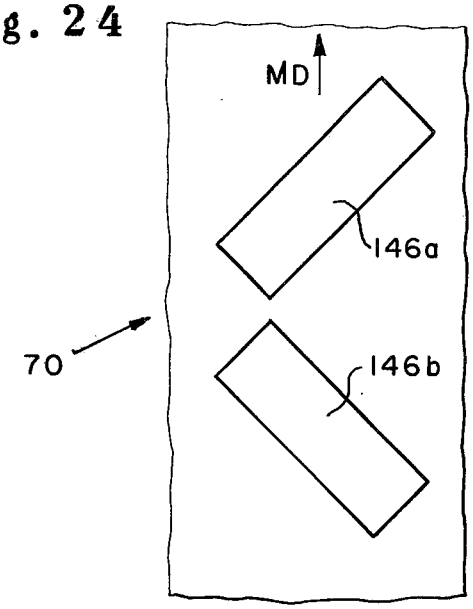
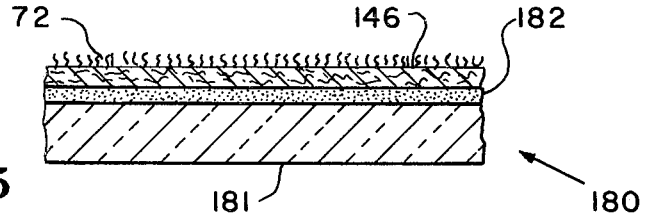
Fig. 25
Fig. 26
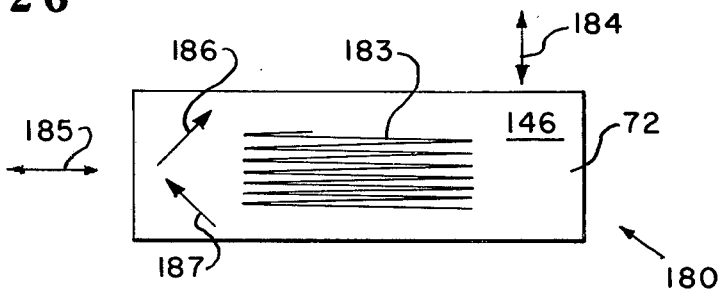

Fig. 27a
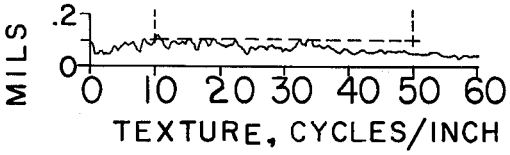
Fig. 27c
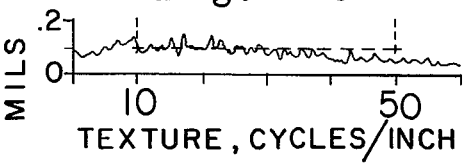
Fig. 27b
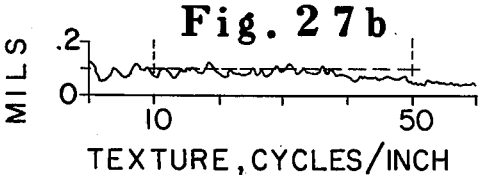
Fig. 27d
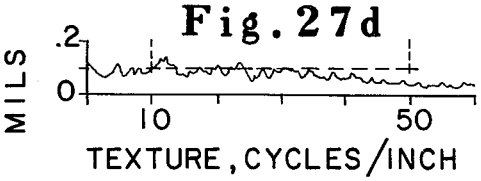
Fig. 28a
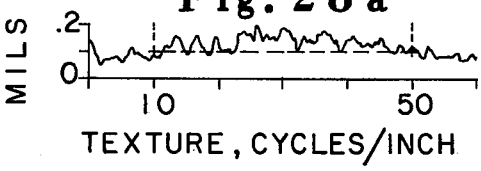
Fig. 29a
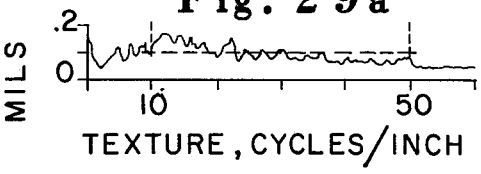
Fig. 28b
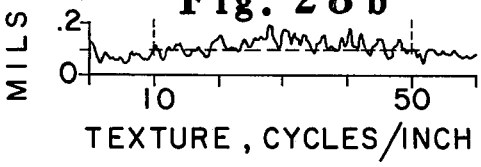
Fig. 29b
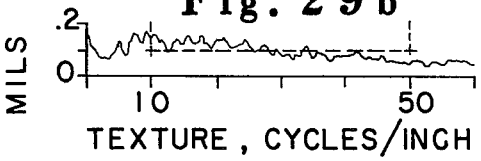
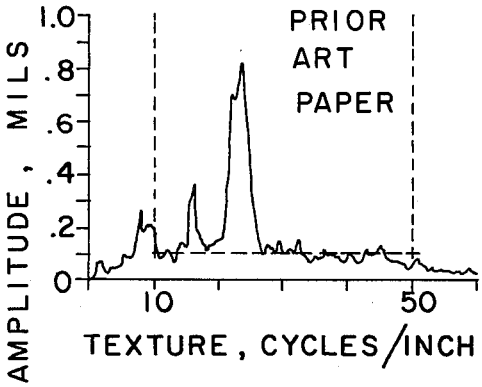
Fig. 30a
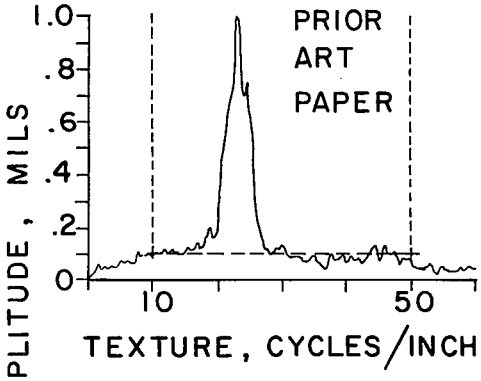
Fig. 30b Fig. 31
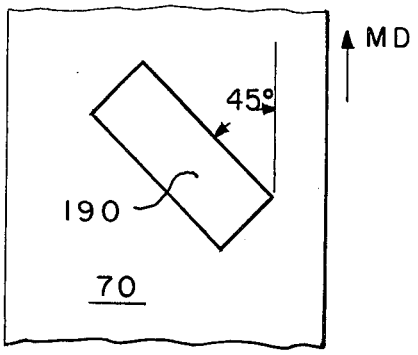
Fig. 32
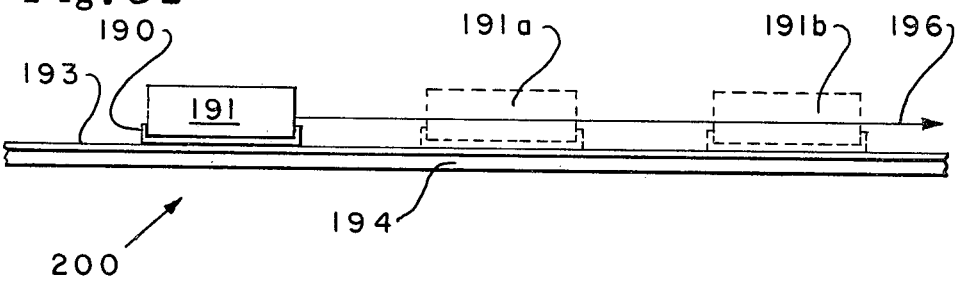
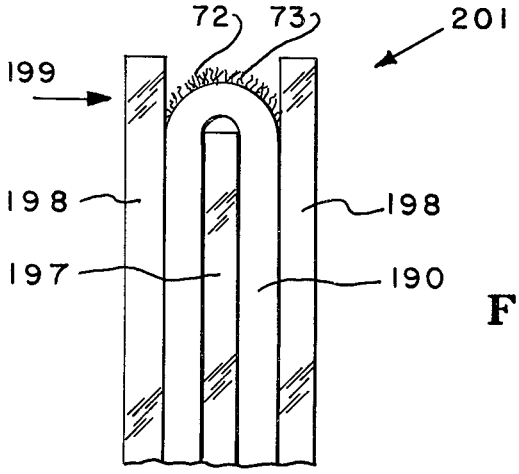
Fig. 33

Fig. 37
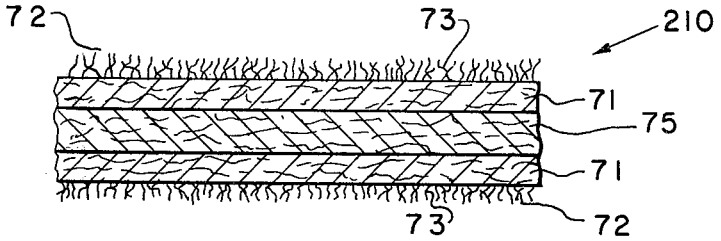
Fig. 38
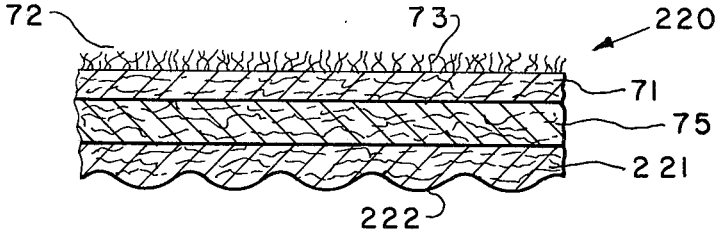
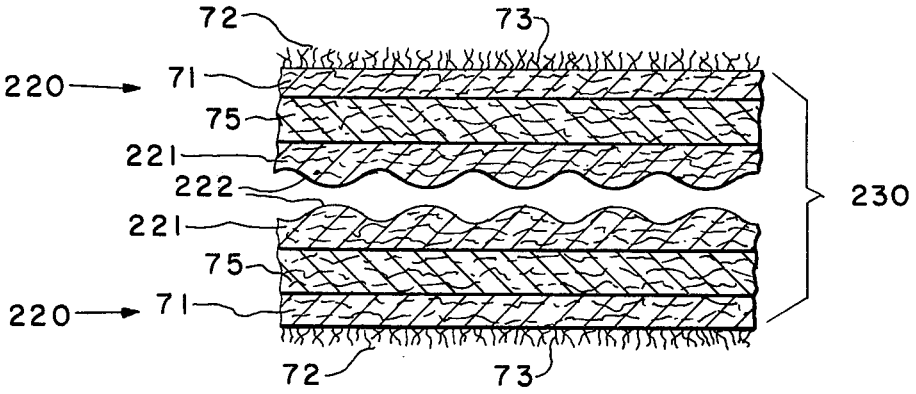
Fig. 39

FFE-INDEX
HTR-TEXTURE
150
100
50
0
0
1
2
3
60
1-3
1-7
1-4
1-8
1-5
1-1
1-2
1-6

FFE-INDEX
HTR-TEXTURE
150
100
50
0
0
1
2
3
60
2-3
2-7
2-4
2-8
2-1
2-5
2-2
2-6

FFE-INDEX
HTR-TEXTURE
200
150
100
50
0
0
1
2
3
60
3-7
3-3
3-8
3-4
3-1
3-5
3-6
3-2

FFE-INDEX
HTR-TEXTURE
200
150
100
50
0
0
1
2
3
60
4-7
4-3
4-5
4-1
4-4
4-8
4-2
4-6

FFE-INDEX
HTR-TEXTURE
150
100
50
0
0
1
2
3
60
5-3
5-7
5-8
5-4
5-1
5-5
5-2
5-6

LAYERED PAPER HAVING A SOFT AND SMOOTH VELUTINOUS SURFACE, AND METHOD OF MAKING SUCH PAPER

DESCRIPTION

1. Technical Field

This invention relates to paper and papermaking: more particularly, to soft and absorbent wet laid tissue paper for such products as toilet tissue and facial tissue.

2. Background Art

By and large, consumers of tissue paper products prefer such products to feel soft. Softness is a generally qualitative, multi-faceted generic term which is believed to be related to such bulk related physical properties as springiness, resilience, compressibility and flexibility; and surface related physical properties such as flaccidness, surface suppleness, and smoothness; smoothness being the relative absence of texture. To illustrate some of the facets of softness, a pillow may be said to be soft because it is sufficiently compressible and resilient to conform to one's head so that zones of high pressure are obviated; or, a flocked inflexible steel plate may be said to have a soft surface; or, a fur may be said to be soft by virtue of comprising a multitude of flaccid, supple hairs which each have one end attached to a flexible skin; or, whereas a satin cloth will generally be perceived to be smooth, it will generally not be regarded as soft in the velvety sense.

Subjective softness determinations are considered to be bipolar in nature: that is, dependent on both human somatic sensibility as well as physical properties of the entity being evaluated for softness. Also, surface softness and bulk softness can be considered separately with respect to tissue paper and tissue paper products.

Human somatic sensibility is discussed at length in *Medical Physiology* by Vernon B. Mountcastle which was published and copyrighted by C. V. Mosby Company in 1974. Mountcastle states, in part, that the human sense of touch involves such qualities as touch-pressure, pain, warmth, cold, and joint position; and that the usual touch/tactile sensory experiences are amalgams of these. Indeed, it seems that surface softness and bulk softness are such complex amalgams.

The above assertion that surface softness and bulk softness can be considered separately is supported by *The Fundamental Properties of Paper Related To Its Uses,* Volume 2 which was edited by Frances Bolam, and copyrighted and published in Great Britain in 1976 at The Pitman Press Bath. This book contains contributions from W. Gallay, and B. H. Hollmark which provide further background with respect to the present invention. First, at page 688, Gallay reported a general tendency to a relationship between the number of fibres or fibre bundles protruding from the surface of a tissue per unit area, with the subjective softness judgment given by a test panel. He opined that this general tendency was undoubtedly disturbed greatly by the length of the fibers and the variation in their degree of flexural rigidity. Moreover, Gallay taught directly away from the present invention by asserting that a large proportion of long-fibered softwood should be used for making soft tissues. Second, Hollmark disclosed a stylus type synthetic fingertip for performing instrumental evaluating of surface softness. He reported, however, that his equipment signal was insufficient to describe surface softness otherwise than to give a very coarse indication—like soft, medium, and rough. As described more fully hereinafter, a human-tactile-response texture quantifying system which is useful for evaluating embodiments of the present invention, also uses a stylus albeit of different design, and for generating data of substantially different character.

Paper which is suitable for sanitary products has long been made by wet laying an embryonic web of homogeneous furnish; mechanically pressing the web between felts to remove water; and final drying. Such paper is generally characterized by smoothness, high density, harsh feel, poor softness, and low absorbency. Creping to break some interfiber bonds, and calendering to reduce creping induced texture are practiced to increase the subjectively perceivable softness of such paper.

High bulk, single layer papers which are said to be soft and absorbent are disclosed in U.S. Pat. Nos. 3,301,746; 3,821,068; and 3,812,000 which are described below. It is believed that the degree of subjectively perceivable softness of these bulked papers is most closely related to the compressibility facet of softness. That is, the greater the bulk, the more easily the paper is compressed and the greater the subjectively perceivable softness. Generally speaking, these papers have high bulk relative to wet-pressed papers by virtue of being formed and substantially pre-dried before being subjected to substantial mechanical compression. This obviates, to some extent, the formation of rigid interfiber hydrogen bonds which would otherwise bond the fibers into a relatively dense and inflexible sheet.

U.S. Pat. No. 3,301,746 which issued Jan. 31, 1967 to L. H. Sanford and J. B. Sisson (hereinafter the Sanford-Sisson patent) discloses, briefly, a relatively highly textured, highly bulked, single layer absorbent paper and process for forming such paper which process comprises the steps of forming an uncompacted paper web; thermally pre-drying the uncompacted web to a fiber consistency of about 30% to about 80% while it is supported on a foraminous imprinting fabric having about 20 to about 60 meshes per inch; imprinting the knuckle pattern of the fabric in the pre-dried uncompacted web at a knuckle pressure of about 1000 p.s.i. to about 12,000 p.s.i.; and final drying which may be followed by creping. As stated hereinabove, the subjectively perceivable softness of this paper is believed to be more related to the compressibility of the paper which results from its high bulk structure than to other softness related properties.

U.S. Pat. No. 3,821,068 which issued June 28, 1974 to Shaw (hereinafter the Shaw patent) discloses a soft, absorbent, creped single layer paper formed by avoiding mechanical compression of the fiber furnish until the sheet is at least 80% dry. As disclosed, the paper is pre-dried without mechanical compression to at least 80% consistency on a foraminous drying fabric. The abstract states that mechanical compression is avoided during pre-drying to substantially reduce formation of papermaking bonds which would form upon compression of the web while wet. Thus, the paper is said to be soft and low density; soft, apparently, because of the compressibility of the low density structure.

U.S. Pat. No. 3,812,000 which issued May 21, 1974 to Salvucci et al. (hereinafter the Salvucci et al. patent) discloses a soft, absorbent, fibrous, single layer sheet material formed by avoiding mechanical compression of an elastomer-containing fiber furnish until the sheet is at least 80% dry. Briefly, the paper made by this process apparently achieves its relative softness from the compressibility or springiness derived by inhibiting the formation of relatively rigid hydrogen bonds by avoiding mechanical compression until subsequently dried (i.e: at least 80% dry), and by providing some resilient elastomeric bonds by including an elastomeric material in the furnish.

The background art also discloses layered paper (and concomitant processes) which paper is suitable for sanitary products, and in which paper the layers comprise different types to achieve different properties. Representative patents which are described more fully hereinafter include U.S. Pat. No. 2,881,669; British Pat. No. 1,117,731; U.S. Pat. No. 3,994,771; British Pat. No. 2,006,296A; Japanese Pat. No. SHO 54-46914 which was opened for publication on Apr. 13, 1979; and U.S. Pat. No. 4,166,001.

U.S. Pat. No. 2,881,669 which issued Apr. 14, 1959 to Thomas et al. discloses and claims paper having long fibers predominating on opposite sides of a short fiber zone, and apparatus for making such long-short-long fiber paper. By way of background, this patent also conclusionally states that "multi-ply" (multi-layered) paper made on twin wire Fourdrinier machines has short fibers distributed on both sides of the paper and the long fibers are concentrated in the middle or central zone of the paper.

British Pat. No. 1,117,731 which was filed by Wycombe Marsh Paper Mills Limited was published June 26, 1968. It identifies Michael Edward White as the inventor and is hereinafter referred to as the White patent. This patent discloses a wet-laid, wet-felt-pressed 2-layer paper which, as disclosed, is believed to have been wet creped from a drying drum, and subsequently finally dried by passing over a plurality of other drying drums. As stated in the patent, this paper comprises a soft and absorbent surfaced short fiber layer, and a strong and smooth-surfaced long fiber layer. The long fiber layer is stated to be preferably laid down first and the short fiber layer laid on top of the long fiber layer; then, the long fiber layer is disposed adjacent the creping/dryer drum. It is believed that such paper which has been wet creped from a dryer drum would be relatively dense and textured, and would not feel particularly soft or smooth as compared to present day commercial tissue paper products.

U.S. Pat. No. 3,994,771 which issued Nov. 30, 1976 to Morgan et al. discloses and claims a Process For Forming A Layered Paper Web Having Improved Bulk, Tactile Impression And Absorbency And Paper Thereof. Briefly, in this process, at least one layer of at least two superposed stratified fibrous layers is bulked into the interfilamentary spaces of a foraminous fabric such as an imprinting fabric mentioned hereinabove with respect to the Sanford-Sisson patent. The resulting paper is relatively highly bulked and textured, and is generally subjectively perceived to be relatively soft. As was stated hereinabove with respect to Sanford-Sisson, it is believed that the perceived softness of this paper is more related to its compressibility than to other softness related properties.

British Pat. No. 2,006,296A which was published May 2, 1979 and which was based for priority on U.S. patent application Ser. No. 840,677 filed on Oct. 11, 1977, recites a wet-laid, dry creped, bulky absorbent tissue paper web of desirable softness and smoothness characteristics, which paper is produced utilizing a very fine mesh transfer and imprinting fabric having between 4900 and 8100 openings per square inch. The paper may be single or two-ply. It is stated to have a relatively high bulk (low density) relative to wet pressed papers by virtue of being pre-dried in the absence of significant pressure until a web consistency of from 40% to 90% is achieved. The pattern of the imprinting fabric is impressed into the pre-dried web, and the web is then final dried and creped. Reference the Sanford-Sisson, Salvucci et al., and Shaw patents described hereinbefore.

Japanese Patent No. SHO 54-46914 which is based for priority on U.S. patent application Ser. No. 828,729 filed on Aug. 29, 1977 discloses a Double Layer Laminate Tissue Product which apparently comprises a predominantly long fibered strength layer which is said to have a soft and smooth outer surface, and a low bond layer; and which is dry creped from a creping surface to which the long fiber layer was adhered. As disclosed and claimed, the paper apparently has small creping induced inter-layer voids. When two such sheets of paper are combined to form two-ply products, they are combined so that long fiber layers face outwardly on both sides of the product.

U.S. Pat. No. 4,166,001 which issued Aug. 28, 1979 to Dunning et al. is titled Multiple Layer Formation Process For Creped Paper for making a soft and bulky creped tissue which apparently also derives its softness from the compressibility due to its bulkiness inasmuch as its outer layers are strongly bonded fibers which are separated by an intermediate central section of weakly bonded fibers. The softness related bulkiness is apparently induced, at least in part, by two creping operations.

As compared to the patents and literature described and discussed above, the present invention provides a layered tissue paper, and products made therefrom which have a soft surface which is comprised primarily of short-fibered hardwood and is characterized by being both smooth and velutinous: smoothness being objectively and inversely related to texture; and velutinous being objectively related to the relative density of relatively flaccid fibers having unbonded free end portions which constitute the soft surface. Indeed, the paper embodiments of the present invention have a quasi-flocked appearance and tactility.

DISCLOSURE OF THE INVENTION

In accordance with one aspect of the present invention there is provided an improved tissue paper, and tissue paper products made therefrom, which paper has a smooth velutinous top surface. Such paper has a high degree of subjectively perceivable softness by virtue of being: multi-layered; having a top surface layer comprising at least about 60% and preferably about 85% or more short papermaking fibers; having an HTR-Texture of the top surface layer of about 1.0 or less, and more preferably about 0.7 or less, and most preferably about 0.1 or less; having an FFE-Index of the top surface of about 60 or more, and preferably about 90 or more. The process for making such paper must include the step of breaking sufficient interfiber bonds between the short papermaking fibers defining its top surface to provide sufficient free end portions thereof to achieve the required FFE-Index of the top surface of the paper. Such bond breaking is preferably achieved by dry creping the paper from a creping surface to which the top surface layer (short fiber layer) has been adhesively secured, and the creping should be effected at a fiber consistency (dryness) of at least about 80% and preferably at least about 95% consistency. Such paper may be made through the use of conventional felts, or foraminous carrier fabrics in vogue today. Such paper may be but is not necessarily of relatively high bulk density.

BRIEF DESCRIPTION OF THE DRAWINGS

While the specification concludes with claims particularly pointing out and distinctly claiming the subject matter regarded as forming the present invention, it is believed the invention will be better understood from the following description taken in conjunction with the accompanying drawings in which:

FIGS. 13 and 14 are views of the top surfaces of the samples as viewed from elevated frontal positions at a relatively shallow downward viewing angle of 15° below horizontal.

FIGS. 15 and 16 are views of the bottom surfaces of the samples as viewed from low frontal positions at a relatively slight upward viewing angle of 15° above horizontal.

FIG. 19 is, relative to FIG. 2, an enlarged scale side elevational view of a fragmentary portion of the papermaking machine shown in FIG. 2, which view shows the angular relation of the doctor blade to the Yankee drying cylinder.

FIG. 20 is a somewhat schematic, side elevational view of an apparatus for combining 2 rolls of paper in back to back relation to form rolls of 2-ply paper for the purpose of ultimately converting the 2-ply paper into 2-ply paper products.

FIG. 21 is a partially peeled apart, fragmentary sectional view of a somewhat schematic representation of a 2-ply tissue paper product embodiment of the present invention.

FIG. 24 is a plan view of a fragmentary sheet of paper embodying the present invention, and on which representations of two orthogonally related texture samples are identified.

FIG. 25 is a fragmentary sectional view of a sample slide as used to determine texture of paper samples when tested by an apparatus such as shown in FIG. 22.

FIG. 26 is a plan view of a texture sample slide of the type shown in FIG. 25, and on which sample the path traced by a texture tracing stylus is identified.

FIGS. 27*a* through 27*d* are texture graphs of four different samples taken from one lot of converted paper (Example 3 described hereinafter) embodying the present invention, and which graphs show the relative magnitude of sample-to-sample variance in the top surface (Yankee side) texture of such paper.

FIGS. 28*a* and 28*b* are texture plots of the back surfaces of two representative samples of the same paper from which Yankee-side samples were taken for FIGS. 27*a* through 27*d*.

FIGS. 29*a* and 29*b* are texture plots of the top surfaces (Yankee side) of two representative samples of calendered and reeled (but not combined or converted) paper of the type which was subsequently converted to make the paper from which samples were taken for FIGS. 27*a* through 27*d*, and 28*a* and 28*b*.

FIGS. 30*a* and 30*b* are texture plots of samples of a contemporary, textured and bulked paper of the type disclosed and claimed in the Morgan et al. patent (U.S. Pat. No. 3,994,771) described hereinbefore.

FIG. 31 is a plan view of a fragmentary sheet of paper showing the layout orientation of a fiber-count (FFE- Index) sample with respect to the machine direction of the paper.

FIG. 32 is a fragmentary, side elevational view of an apparatus for brushing paper samples having a velutinous surface to facilitate ascertaining the relative density of such free fiber ends, which relative density is hereinafter designated and described as the FFE-Index.

FIG. 33 is an enlarged scale, fragmentary view of a vertically extending edge of an FFE-Index sample slide.

FIG. 37 is a quasi sectional view of a line drawing schematic representation of a 3-layer paper sheet embodiment of the present invention, which sheet has two smooth velutinous surfaces.

FIG. 38 is a quasi sectional view of a line drawing schematic representation of a 3-layer paper sheet embodiment of the present invention, which sheet has a smooth velutinous top surface and a relatively highly textured bottom surface.

FIG. 39 is a quasi sectional view of a line drawing schematic representation of a two-ply tissue paper product wherein each ply is a sheet of paper like that shown in FIG. 38, and wherein both outside surfaces of the product are smooth and velutinous.

DETAILED DESCRIPTION OF THE INVENTION

Figure 1:
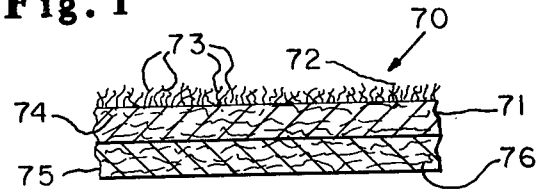
FIG. 1 is a quasi sectional view of a line drawing schematic representation of a two-layer paper sheet embodiment of the present invention, which sheet has a soft and smooth velutinous top surface.

A line drawing sectional view of an exemplary paper sheet 70 embodying the present invention is shown in FIG. 1 to comprise a top layer 71 having a velutinous top surface 72 defined by free fiber ends 73 of relatively short papermaking fibers 74, and a second layer 75 of fibrous papermaking material such as relatively long papermaking fibers 76. The top surface 72 is also referred to as the Yankee-side of paper 70, and the opposite side is also referred to as the off-Yankee-side because of their respective orientations with the Yankee dryer surface when made as described below. Paper 70, preferably has a total basis weight of from about 6 to about 40 pounds per 3,000 square feet (about 10 to about 65 grams per square meter), and layer 71 preferably has a basis weight of from about 3 to about 35 pounds per 3,000 square feet (about 5 to about 57 grams per square meter), which basis weights are with respect to paper 70 in an uncreped state. More preferably, the total basis weight of paper 70 is from about 7 to about 25 pounds per 3,000 square feet (about 11 to about 41 grams per square meter) and the basis weight of layer 71 is from about 3 to about 20 pounds per 3,000 square feet (about 5 to about 33 grams per square meter) as measured in an uncreped state.

Figure 2:
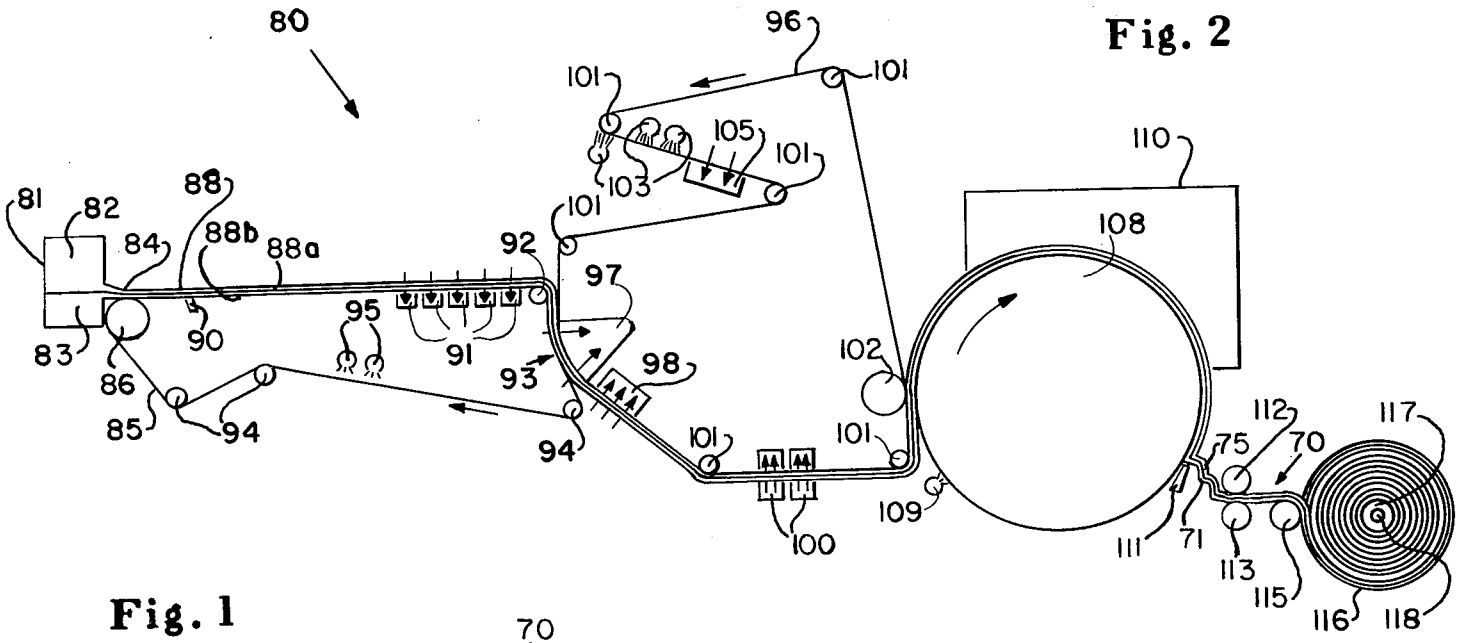
FIG. 2 is side elevational, somewhat schematic view of a preferred papermaking machine for manufacturing paper according to and embodying the present invention.

FIG. 2 is side elevational view of a papermaking machine 80 for manufacturing paper according to the method of the present invention, and which will be described more fully after the following brief descriptions of the invention, and the graphs shown on FIGS. 3 through 10*a* and 10*b*.

Briefly, the present invention provides a multi-layer tissue paper sheet which is preferably wet laid and wherein the top layer is constituted and configured to precipitate a human-tactile-response of velvety smoothness and softness for users of such paper or paper products made therefrom: for instance, facial tissue and toilet tissue products. This is provided by constituting the top layer of a relatively low bond furnish comprising at least about 60% of relatively short papermaking fibers having average lengths of from about 0.25 mm to about 1.5 mm. More preferably, the top layer will comprise about 85% or more of such relatively short papermaking fibers. This layer will have relatively low strength so it is united with at least another layer which is so constituted and configured to provide the ultimate paper sheet and paper products with sufficient wet and dry strength for their intended purposes. As will also be described more fully hereinafter, paper sheet embodiments of the present invention can comprise three layers wherein both outside surfaces are velutinous, or wherein one outside layer is relatively highly textured and bulked. When two plies of the latter three-layer paper sheet are united with their velutinous surfaces facing outwardly, the product is both highly bulked, and velvety soft and smooth on both outside surfaces.

The method of making such paper embodiments of the present invention preferably comprises wet laying suitably constituted furnishes as described above so that the sheet has a relatively low degree of human-tactile-response texture; that is, texture which is virtually imperceptible to a human through the sense of touch. Preferably the level of texture will be no greater than an HTR-Texture of 1.0 as hereinafter defined; and more preferably an HTR-Texture of no greater than 0.7; and most preferably an HTR-Texture of about 0.1 or even less. Then, when the paper is sufficiently dried to virtually preclude subsequent autogeneous inter-fiber bonding, a sufficient number of inter-fiber bonds are broken between the fibers which define the top surface of the top layer of the sheet to provide a free-fiber-end index (FFE-Index as hereinafter defined) of at least about 60, and more preferably 90 or more. Such bond breaking could of course be accomplished manually with a micro-pick but can effectively be accomplished by brushing or blading the top surface, or by dry creping the sheet. When the sheet is creped to achieve the desired FFE-Index, it is most effectively done after adhering the top surface (short fiber) of the sheet to a creping surface, and effecting creping after the sheet is dried to a fiber consistency of about 80% or more; and more preferably dried prior to creping to a fiber consistency of about b 95% or more. Creping, however, induces increased texture which may then need to be reduced to achieve the required low level of HTR-Texture. This is most effectively accomplished by calendering the sheet and drawing out the crepe sufficiently to achieve the required level of HTR-Texture. Such calendering and crepe drawing may be accomplished at the dry end of the papermaking machine as illustrated in FIG. 2, or as an adjunct to subsequent combining and/or converting operations, or a combination thereof as more fully described hereinafter.

Before describing the methods of determining HTR-Texture and FFE-Index, and describing specific examples of the present invention, FIGS. 3 through 10*a* and 10*b* (which will also be more fully discussed hereinafter) are referred to briefly to provide a graphical basis for comprehending the following descriptions of the various facets of the present invention. The data plotted in these graphs is also tabulated: reference Table Ia for FIG. 3; Table II for FIGS. 4 and 5; Table IIIa for FIGS. 6 and 7; Table IIIb for FIGS. 8 and 9; and Table IVa for FIG. 10*a;* and Table IVb for FIG. 10*b*.

Figure 3:
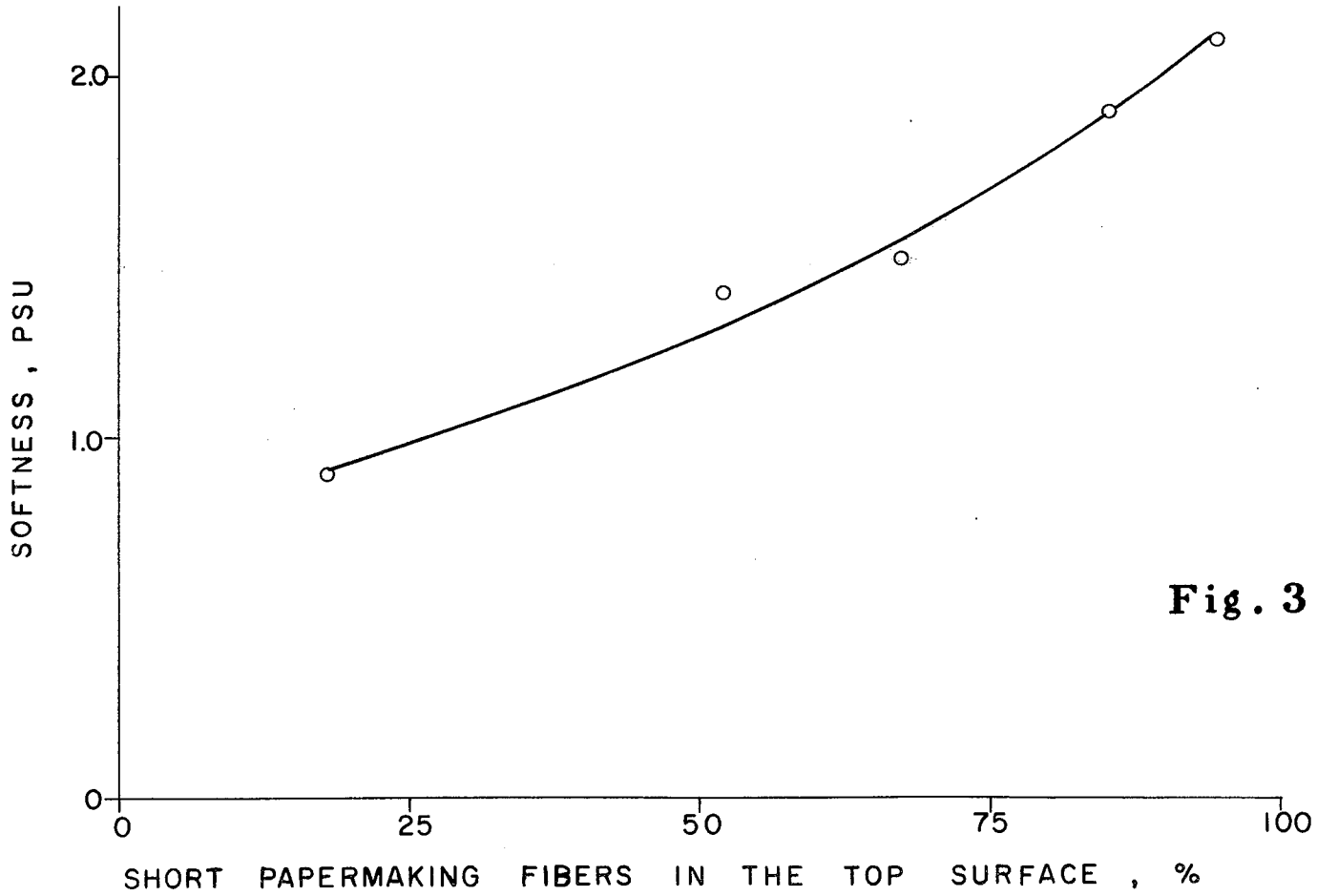
FIG. 3 is a graph showing the direct relationship between softness and percent short fibers in the top surface layer of each of several samples of paper embodying the present invention.

FIG. 3 illustrates the direct relation between the degree of subjective softness of 2-layer paper made according to the process of the present invention as a function of the percent of relatively short papermaking fibers in the top layer of the paper having average lengths of from about 0.25 mm to about 1.5 mm while the remainder of the top layer was comprised essentially of relatively long papermaking fibers: i.e., cellulosic fibers having average lengths of about 2.0 mm or greater. The second layers of all of the numbered Examples described hereinafter were comprised primarily of such relatively long papermaking fibers.

TABLE Ia-continued

Softness, Texture and Velutinous Effects of Varying % Short Fiber in Top Layer, Two Layer Paper Having Long-Fiber Bottom Layer

| Layer Purity Sample Designator | % Short Fibers, Top Layer | Softness, PSU | FFE-Index Brushed Yes | FFE-Index Brushed No | HTR-Texture |
|---|---|---|---|---|---|

FIG. 3

TABLE Ib

Additional Data, Paper Samples Made By Varying % Short Fiber in Top Layer, Two Layer Paper Having Long-Fiber Bottom Layer

| Layer Purity Sample Designator | Basis Wt. lbs/ 3000ft$^2$ | Caliper, mils/4 plies | Bulk Density, cm$^3$/gm | Tensile Strength, gms/inch MD | Tensile Strength, gms/inch CD | MD Stretch, Percent |
|---|---|---|---|---|---|---|
| LP-95 | 18.6 | 17.6 | 7.4 | 314 | 193 | 16 |
| LP-86 | 20.3 | 21.9 | 8.4 | 276 | 243 | 23 |
| LP-68 | 20.4 | 22.4 | 8.5 | 261 | 231 | 14 |
| LP-52 | 20.0 | 22.0 | 8.5 | 408 | 273 | 26 |
| LP-17 | 19.8 | 20.6 | 8.1 | 338 | 222 | 21 |

TABLE II

Comparative Data, Exemplary Tissue Paper Product Embodiment of Present Invention and Plurality of Contemporary Tissue Paper Products

| Product Designator | Plies | Softness, PSU, Raw Data | HTR-Texture | Softness, PSU, Normalized to FFE = 124 2-Ply Basis | FFE-Index | Softness, PSU, Normalized to HTR-Texture = 0.07, 2-Ply Basis |
|---|---|---|---|---|---|---|
| Present Invention: | | | | | | |
| Example 1 | 2 | 2.1 | 0.07 | 2.1 | 124 | 2.1 |
| Contemporary Products: | | | | | | |
| CP-1-1 | 1 | 1.2 | 3.01 | 1.0 | 180 | 2.4 |
| CP-1-2 | 1 | 0.5 | 1.99 | 1.6 | 80 | 1.4 |
| CP-1-3 | 1 | 0.4 | 2.16 | 1.5 | 82 | 1.4 |
| CP-1-4 | 1 | −1.2 | 1.11 | 1.3 | 37 | −0.6 |
| CP-1-5 | 1 | −1.4 | 0.16 | 2.2 | 16 | −1.1 |
| CP-2-1 | 2 | 1.8 | 1.18 | 1.7 | 130 | 2.2 |
| CP-2-2 | 2 | 1.2 | 1.13 | 1.8 | 90 | 1.6 |
| CP-2-3 | 2 | 0.5 | 1.07 | 1.5 | 77 | 0.8 |
| CP-2-4 | 2 | −0.2 | 0.22 | 1.8 | 42 | −0.2 |
| CP-2-5 | 2 | 0.0 | 0.04 | 2.5 | 29 | 0.0 |
| CP-2-6 | 2 | −0.3 | 0.71 | 2.0 | 34 | −0.1 |
| CP-2-7 | 2 | −0.5 | 0.24 | 2.1 | 27 | −0.4 |
| CP-2-8 | 2 | −0.6 | 0.02 | 1.8 | 31 | −0.6 |

FIG. 4 FIG. 5

TABLE Ia

Softness, Texture and Velutinous Effects of Varying % Short Fiber in Top Layer, Two Layer Paper Having Long-Fiber Bottom Layer

| Layer Purity Sample Designator | % Short Fibers, Top Layer | Softness, PSU | FFE-Index Brushed Yes | FFE-Index Brushed No | HTR-Texture |
|---|---|---|---|---|---|
| LP-95 | 95 | 2.1 | 124 | 91 | 0.07 |
| LP-86 | 86 | 1.9 | 90 | 50 | 0.20 |
| LP-68 | 68 | 1.5 | 72 | 19 | 0.04 |
| LP-52 | 52 | 1.4 | 65 | 34 | 0.18 |
| LP-17 | 17 | 0.9 | 43 | — | — |

TABLE IIIa

HTR-Texture & FFE-Index v. Percent Fiber Consistency When Creped, Papermaking Process Using Foraminous Fabric Carrier And Blow Through Pre-Yankee Pre-Drying

| Fiber Consistency When Creped, % | HTR-Texture | FFE-Index |
|---|---|---|
| 75 | 4.9 | 96 |
| 79 | 0.4 | 146 |
| 88 | 0.5 | 160 |
| 90 | 1.3 | 142 |
| 95 | — | 156 |
| 99 | 1.4 | 189 |

TABLE IIIa-continued

HTR-Texture & FFE-Index v. Percent Fiber Consistency When Creped, Papermaking Process Using Foraminous Fabric Carrier And Blow Through Pre-Yankee Pre-Drying

| Fiber Consistency When Creped, % | HTR-Texture | FFE-Index |
|---|---|---|

FIG. 6

FIG. 7

TABLE IIIb

HTR-Texture & FFE-Index v. Percent Fiber Consistency When Creped, Papermaking Process Using Pressure On Felt Pre-Yankee-Dryer Dewatering

| Fiber Consistency When Creped, % | HTR-Texture | FFE-Index |
|---|---|---|
| 73 | 4.3 | 88 |
| 77 | 2.8 | 111 |
| 81 | 2.5 | 114 |
| 88 | 2.2 | 118 |
| 95 | 1.5 | 139 |
| 98 | 2.1 | 165 |

FIG. 8

FIG. 9

TABLE IVa

Trend, Softness v. Bulk Density Contemporary Tissue Paper Products, Reference FIG. 10a

| Contemporary Product Designator | Tissue Product Type | No. of Plies | Softness*, PSU | Bulk Density, $cm^3/gm$ |
|---|---|---|---|---|
| CP-1-1 | Toilet | 1 | 1.2 | 11.1 |
| CP-1-2 | Toilet | 1 | 0.5 | 10.9 |
| CP-1-3 | Toilet | 1 | 0.4 | 9.6 |
| CP-1-4 | Toilet | 1 | −1.2 | 7.0 |
| CP-1-5 | Toilet | 1 | −1.4 | 5.6 |
| CP-2-1 | Toilet | 2 | 1.8 | 11.2 |
| CP-2-2 | Toilet | 2 | 1.2 | 10.4 |
| CP-2-3 | Toilet | 2 | 0.5 | 9.6 |
| CP-2-4 | Toilet | 2 | −0.2 | 7.2 |
| CP-2-5 | Facial | 2 | 0.0 | 5.3 |
| CP-2-6 | Toilet | 2 | −0.3 | 8.1 |
| CP-2-7 | Toilet | 2 | −0.5 | 7.5 |
| CP-2-8 | Facial | 2 | −0.6 | 6.3 |

TABLE IVb

Spread, Softness v. Bulk Density, 5 Examples of Present Invention Tissue Paper Products Reference FIG. 10b

| Example Designator | Tissue Product Type | No. of Plies | Softness*, PSU | Bulk Density, $cm^3/gm$ |
|---|---|---|---|---|
| Example 1 | Facial | 2 | 2.1 | 7.4 |
| Example 2 | Toilet | 2 | 1.5 | 10.0 |
| Example 3 | Facial | 2 | 1.9 | 8.7 |
| Example 4 | Facial | 1 | 1.1 | 5.5 |
| Example 5 | Facial | 2 | 1.2 | 8.3 |

*Because of the subjective nature of softness determinations, the softness units on these two tables may not be equal.

Figure 4:
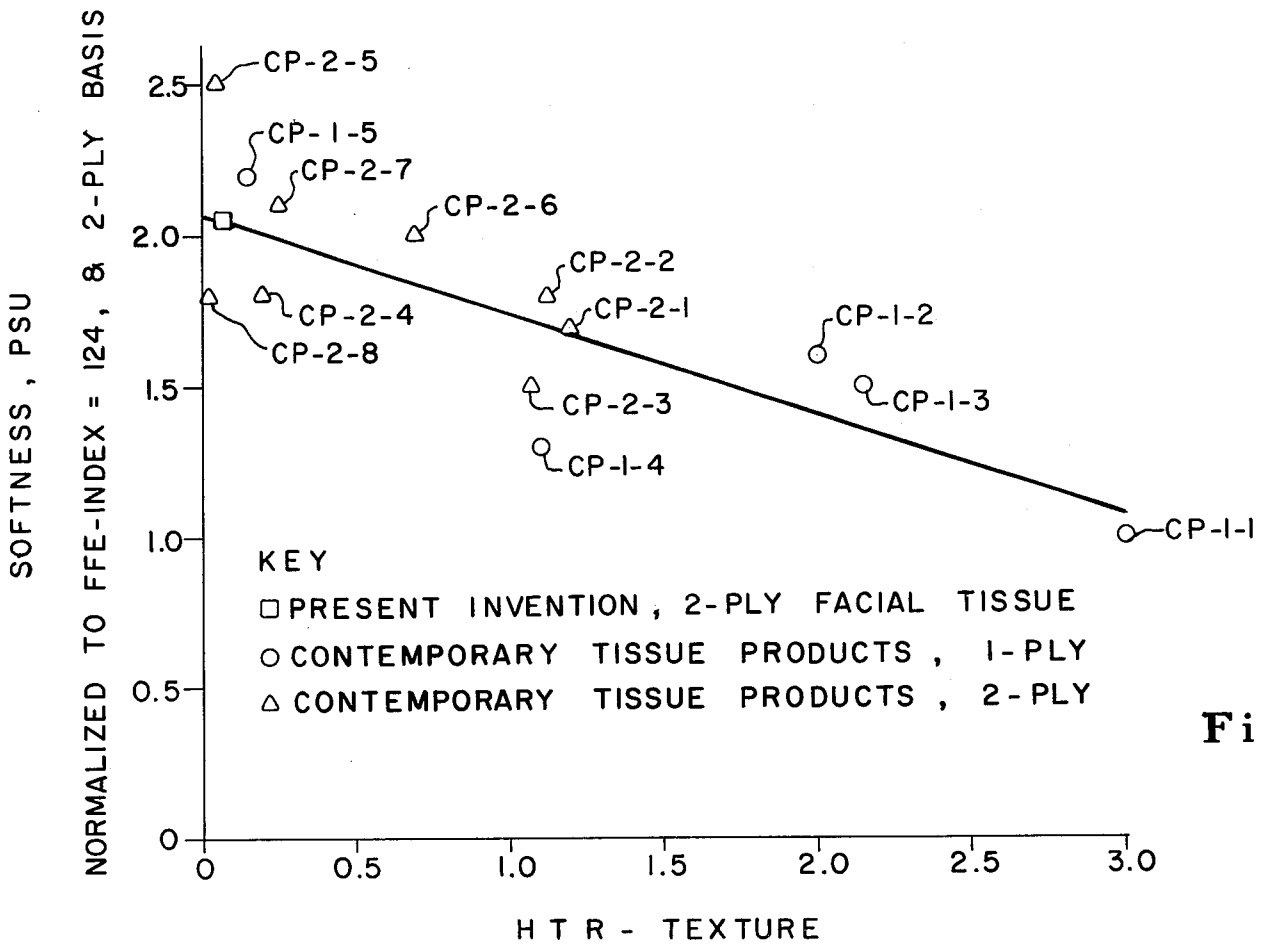
FIGS. 4 and 5 are graphs of normalized softness v. HTR-Texture data and normalized softness v. FFE-Index data, respectively, derived from testing samples of paper embodying the present invention as well as samples of several contemporary tissue paper products.
Figure 5:
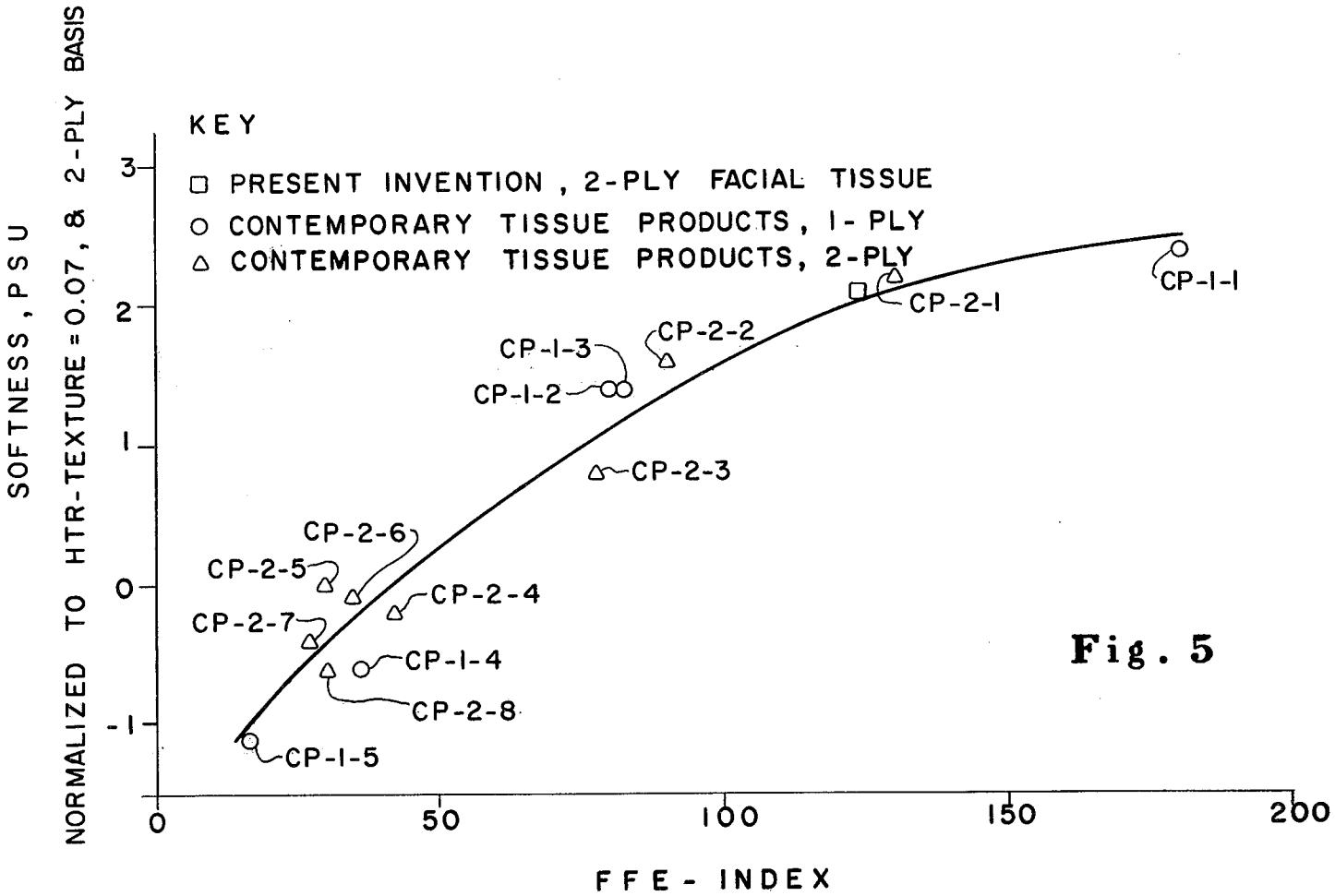

FIGS. 4 and 5 illustrate the inverse relation between softness and HTR-Texture, and the direct relation between softness and FFE-Index, respectively, of a number of tissue paper products which number includes an exemplary two-layer embodiment of the present invention having a relatively low HTR-Texture and a relatively high FFE-Index. These softness data were normalized to a common FFE-Index of 124 in FIG. 4, and to a common HTR-Texture of 0.07 in FIG. 5, according to a least squares regression equation derived from a statistical analysis of the raw data presented in Table II. Also, whereas the above described inverse relation between softness and HTR-Texture, and the direct relation between softness and FFE-Index are believed to be universal, the curves shown in FIGS. 4 and 5 were determined for a specific set of samples and such curves could be somewhat different for other sets of samples: that is, their slopes, intercept, and degrees of curvature could be somewhat different but none the less evidence the universe and direct relations recited above.

Figure 6:
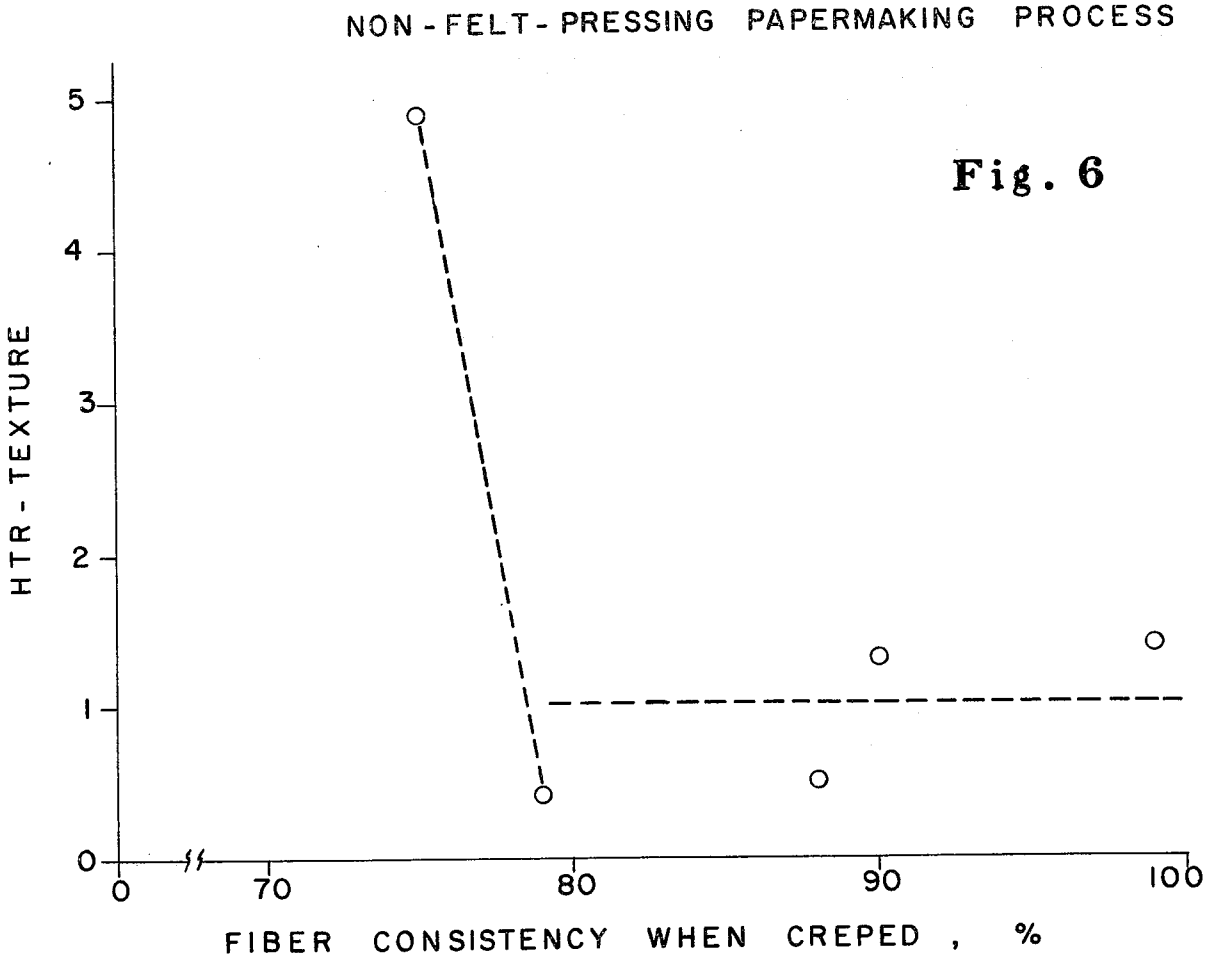
FIGS. 6 and 7 are graphs of data showing HTR-Texture v. Percent Fiber Consistency When Creped, and FFE-Index v. Percent Fiber Consistency When Creped, respectively, of paper made by varying doctor blade moisture while making paper by the process of the present invention using a foraminous carrier fabric, and by avoiding substantial compressive force on the paper prior to transferring the paper to a Yankee dryer/creping drum.
Figure 7:
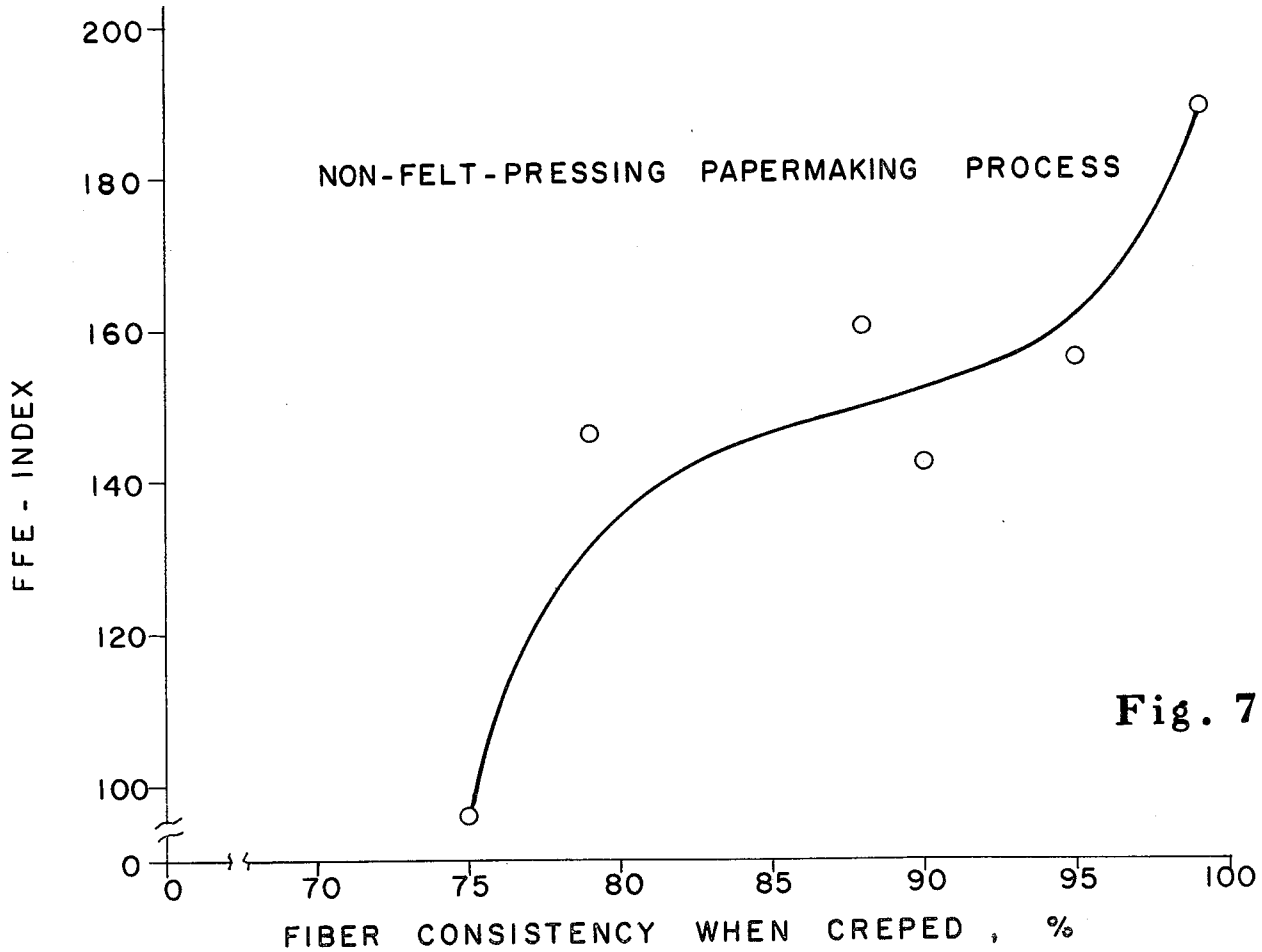
Figure 8:
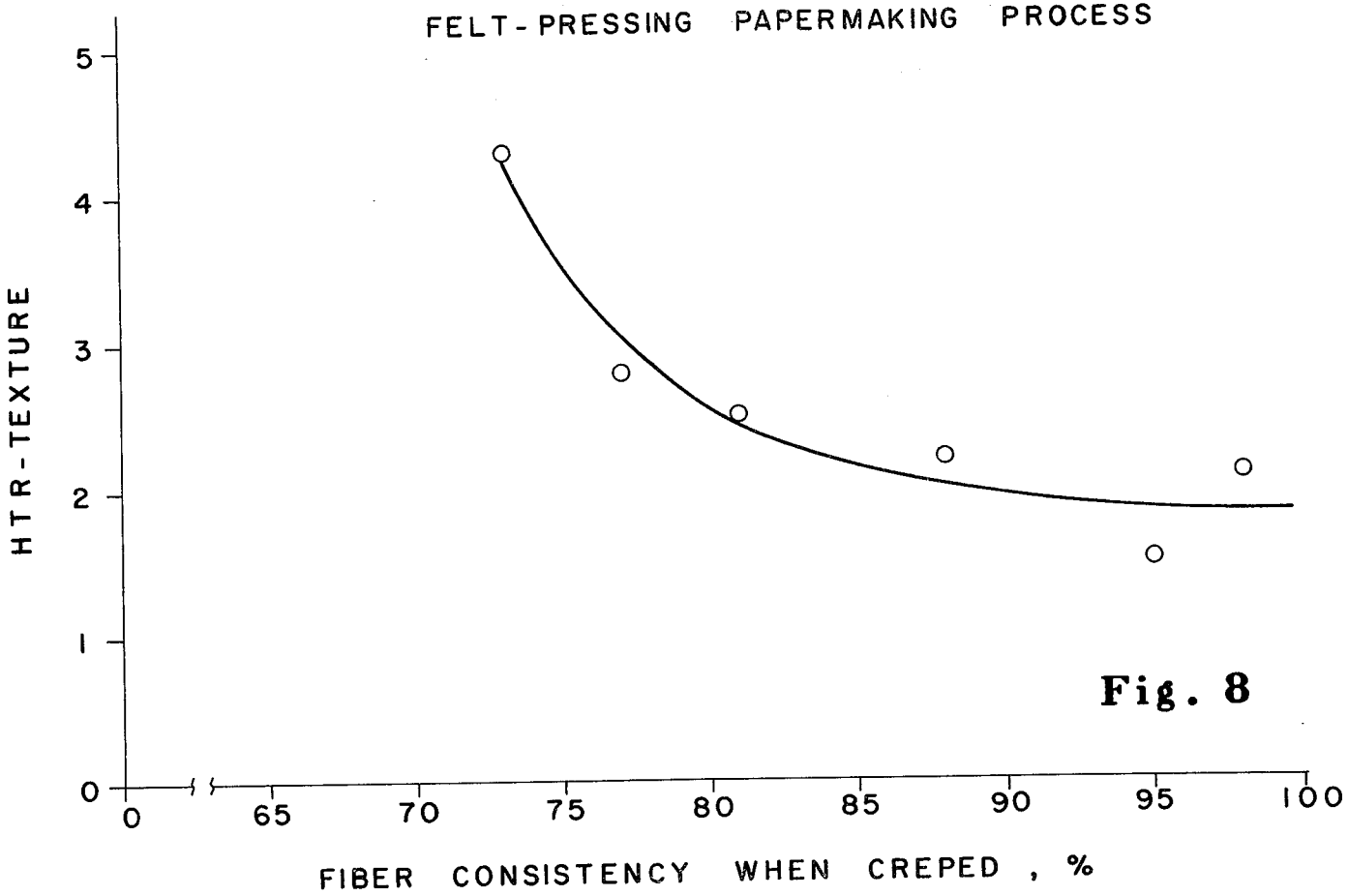
FIGS. 8 and 9 are graphs of data showing HTR-Texture v. Percent Fiber Consistency When Creped, and FFE-Index v. Percent Fiber Consistency When Creped, respectively, of paper made by the process of the present invention using a felt carrier fabric.
Figure 9:
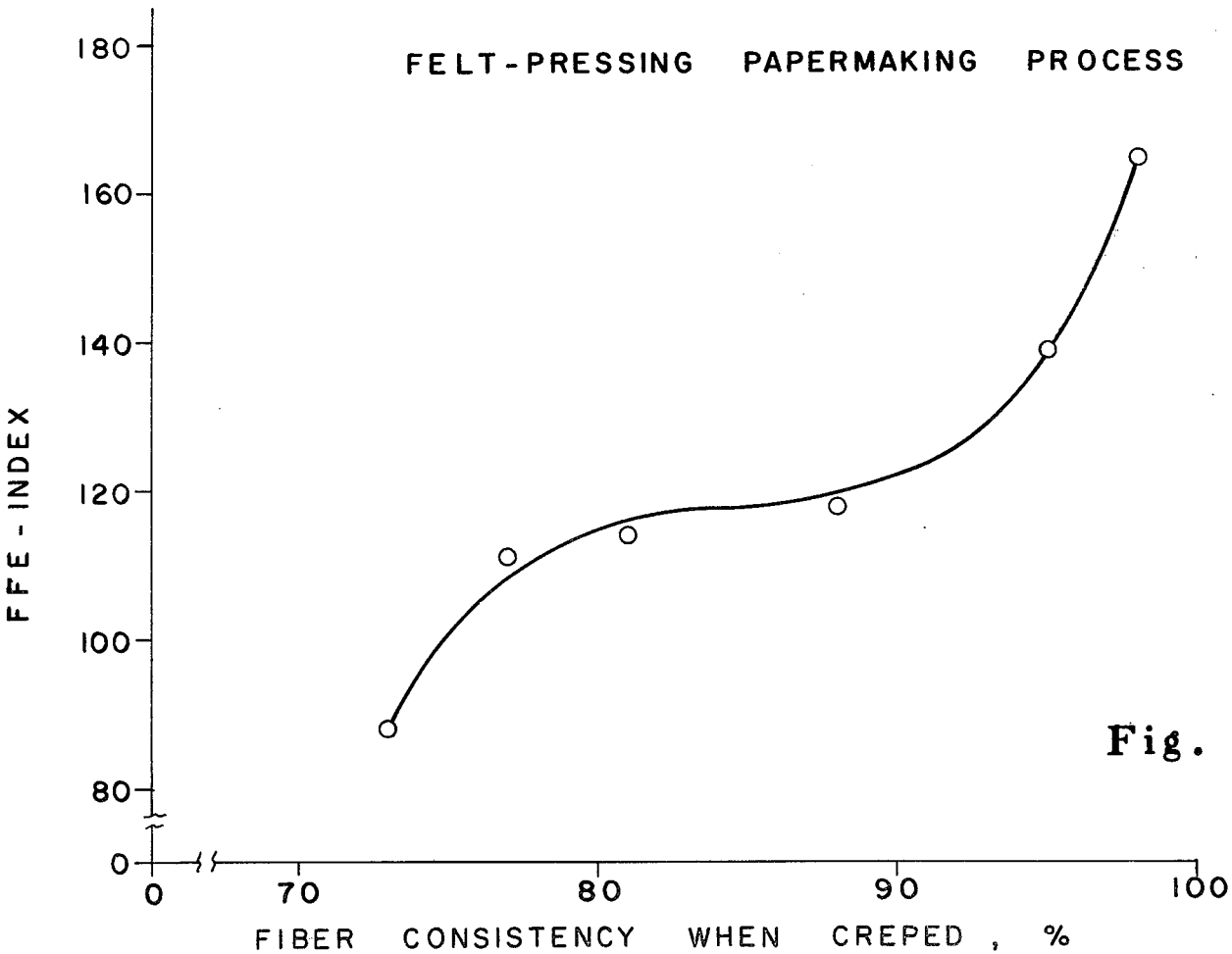

FIGS. 6 and 7 illustrate the improved (lower) level of HTR-Texture and increased FFE-Index, respectively, which results from creping paper made according to the present invention through the use of a foraminous carrier fabric as a function of increasing fiber consistency when creped. FIGS. 8 and 9 illustrate the improved (lower) level of HTR-Texture and increased FFE-Index, respectively which results from creping paper made according to the present invention through the use of a felt carrier fabric as a function of increasing fiber consistency when creped. The paper samples from which the data were obtained from FIGS. 6 through 9 were creped but not calendered, combined, or converted.

Figure 10A:
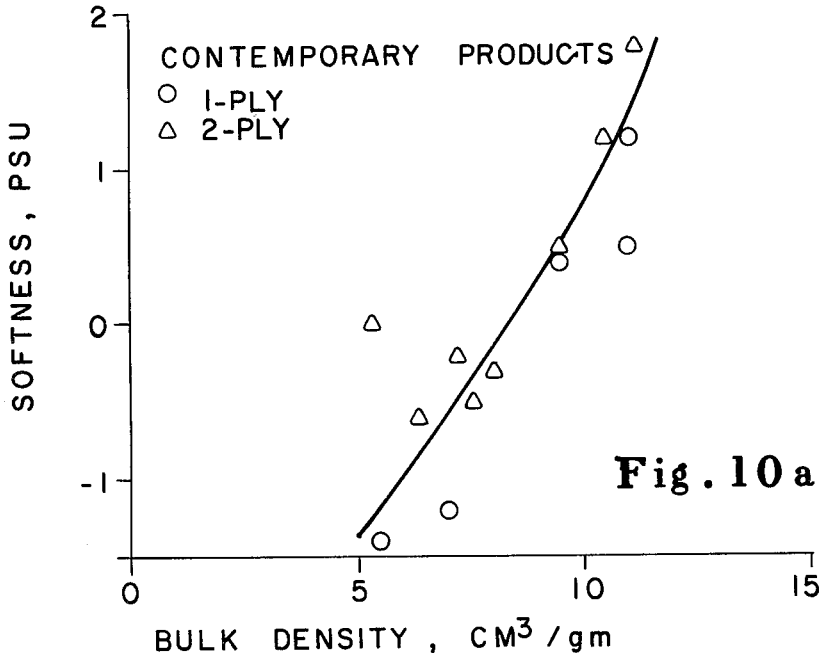
FIG. 10*a* is a graph of Softness v. Bulk Density data derived from samples of several contemporary tissue paper products.
Figure 10B:
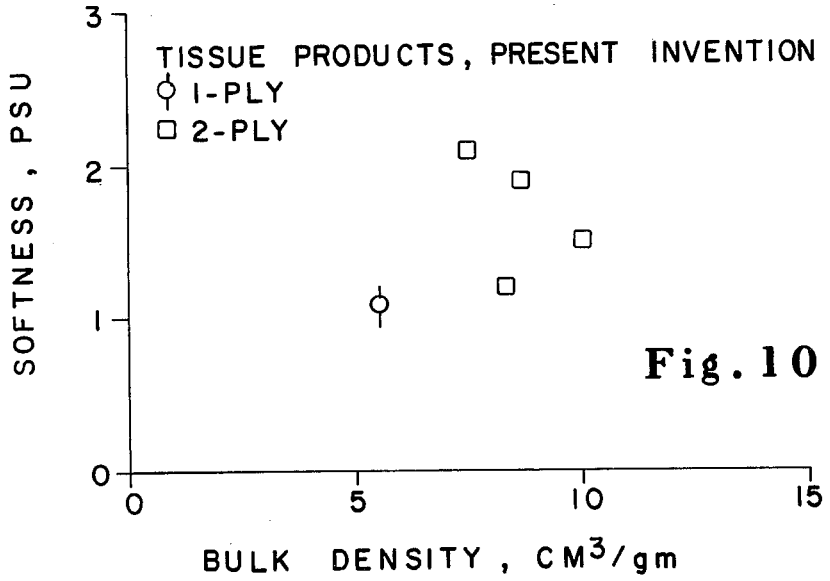
FIG. 10*b* is a graph of Softness v. Bulk Density data derived from five examples of paper embodying the present invention.

FIGS. 10*a* and 10*b*, considered together, illustrate to some extent the relative independence of paper embodiments of the present invention from the interdependent relation between bulk density and softness which has heretofore been considered virtually axiomatic with respect to tissue paper products. These data are plotted on two graphs because of a lack of identity of the softness data units which were precipitated by the data grouping. That is, the data for FIG. 10*a* was obtained from a different set of samples than the data for FIG. 10*b* so the scale factors could be but are not necessarily different because of the subjective aspect of such testing.

Parenthetically, with respect to subjective softness testing to obtain the softness data reported herein in PSU (Panel-Score-Units), a number of practiced softness judges are asked to rate the relative softness of a plurality of paired samples. The data are analyzed by a statistical method known as a paired comparison analysis. In this method, pairs of samples are first identified as such. Then, the pairs of samples are judged one pair at a time by each judge: one sample of each pair being designated X and the other Y. Briefly, each X sample is graded against its paired Y sample as follows:

1. a grade of zero is given if X and Y are judged to be equally soft;
2. a grade of plus one is given if X is judged to maybe a little softer than Y, and a grade to minus one is given if Y is judged to maybe be a little softer than X;
3. a grade of plus two is given if X is judged to surely be a little softer than Y, and a grade of minus two is given if Y is judged to surely be a little softer than X;
4. a grade of plus three is given to X if it is judged to be a lot softer than Y, and a grade of minus three is given if Y is judged to be a lot softer than X; and, lastly, 5. a grade of plus four is given to X if it is judged to be a whole lot softer than Y, and a grade of minus 4 is given if Y is judged to be a whole lot softer than X.

The resulting data from all judges and all sample pairs are then pair-averaged and rank ordered according to their grades. Then, the rank is shifted up or down in value as required to give a zero PSU value to whichever sample is chosen to be the zero-base standard. The other samples then have plus or minus values as determined by their relative grades with respect to the zero base standard. The grade values of the samples reported herein have been proportionally changed to scale the grades in PSU units so that about 0.2 PSU represents a significant difference in subjectively perceived softness.

Referring again to FIG. 2, papermaking machine 80 comprises a duplex headbox 81 having a top chamber 82 and a bottom chamber 83, an over and under duplex slice 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 while a second furnish is pumped through bottom chamber 83 and thence out of the duplex slice 84 in over and under relation onto Fourdrinier wire 85 to form thereon an embryonic web 88 comprising layers 88*a* and 88*b*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 and an off-Yankee-side layer 75. Paper sheet 70 then passes between calender rolls 112 and 113, about a circumferential portion of reel 115, and thence is wound into a roll 116 on a core 117 disposed on shaft 118.

Still referring to FIG. 2, the genesis of Yankee-side layer 71 of paper sheet 70 is the furnish pumped through bottom chamber 83 of headbox 81, and which furnish is applied directly to the Fourdrinier wire 85 whereupon it becomes layer 88*b* of embryonic web 88. Similarly, the genesis of the off-Yankee-side layer 75 of paper sheet 70 is the furnish delivered through top chamber 82 of headbox 81, and which furnish forms layer 88*a* on top of layer 88*b* of embryonic web 88.

Papermaking machine 80 is preferably used to make paper embodying the present invention by supplying a short-fiber furnish through bottom chamber 83 which comprises at least 60% and is preferably comprised essentially of relatively short papermaking fibers having average lengths of from about 0.25 mm to about 1.5 mm; reference FIG. 3. These would commonly be hardwood fibers which are identified more specifically in Examples 1 through 5 which are described hereinafter. Concurrently, a long-fiber furnish is preferably delivered through top chamber 82. Such a long-fiber furnish would commonly comprise softwood fibers having average lengths of about 2.0 mm or more. Thus, the resulting paper sheet 70 comprises a low strength, short fiber layer, and a high strength, long fiber layer. The long fiber layer 75 provides the strength required for sheet 70 to be suitable for its intended purposes (i.e.: toilet tissue, or facial tissue, or the like) while, when creped and calendered, the outwardly facing surface 72 of the short fiber layer 71 is soft, smooth, and velutinous; reference FIG. 1.

Further, with respect to making paper sheet 70 embodying the present invention on papermaking machine 80, FIG. 2, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the interfilamentary spaces of the fabric 96. Preferably, such carrier fabrics will have mesh counts of greater than 60 per inch in the cross-machine-direction to precipitate a high crepe frequency which, in turn, provides a relatively low degree of texture in the creped paper. Also, with respect to the process conditions for making exemplary paper sheet 70, the paper web should be dried to about 80% fiber consistency, and more preferably to about 95% fiber consistency prior to creping: reference FIGS. 6 and 7 with respect to the impact of doctor blade fiber consistency on HTR-Texture and FFE-Index, respectively.

Figure 11:
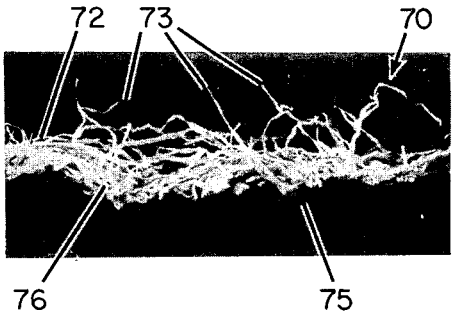
FIG. 11 is an enlarged edge-on electron microscope photographic view of a fragmentary creped and calendered two-layer sheet of paper which paper sheet is an exemplary embodiment of the present invention.

FIG. 11 is an enlarged, edge-on electron microscope photographic view of a creped and calendered exemplary embodiment of paper sheet 70, FIG. 1, which clearly shows the sheet to be loosely structured, and to have upstanding free (unbonded) fiber ends 73 which corporately define the top surface 72 of paper sheet 70.

Figure 12:
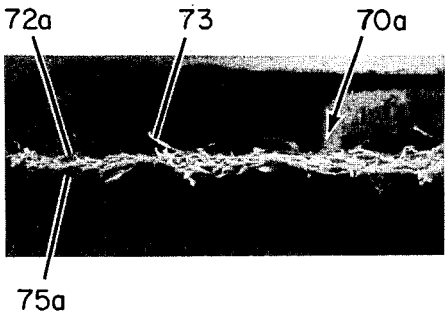
FIG. 12 is an enlarged edge-on electron microscope photographic view of a non-creped and non-calendered two-layer sheet of paper of the same genesis as the sheet of paper shown in FIG. 11.

FIG. 12 is an enlarged, edge-on electron microscope photographic view of a non-creped and non-calendered 2-layer sheet of paper 70*a* of the same genesis as paper sheet 70, FIG. 11. This illustrates that the sheet 70*a*, prior to creping and calendering, has a relatively tightly bound structure and few fiber ends upstanding from its top surface. Thus, the creping and calendering to convert paper sheet 70*a*, FIG. 12, to paper sheet 70, FIG. 11, greatly loosens the structure and precipitates a high count of upstanding unbonded free fiber ends.

Figure 13:
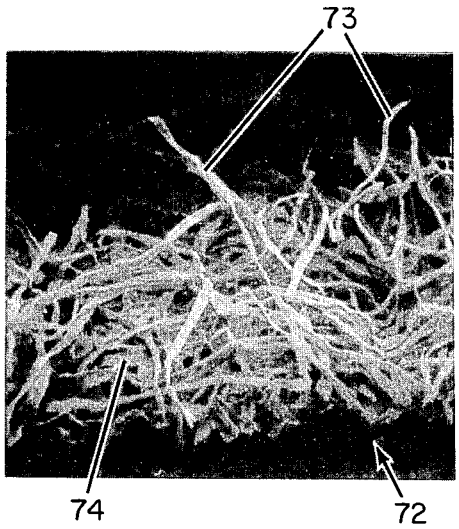
FIGS. 13 and 14 are electron microscope photographic views of the paper sheets shown in FIGS. 11 and 12, respectively, except
Figure 14:
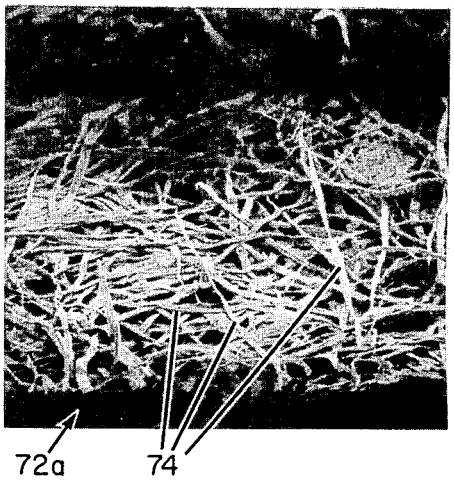
Figure 15:
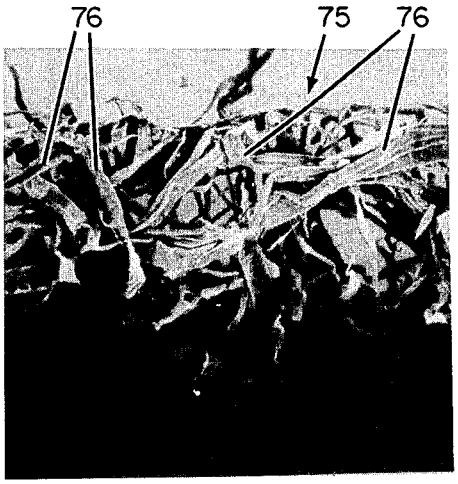
FIGS. 15 and 16 are electron microscope photographic views of the paper sheets shown in FIGS. 11 and 12, respectively, except
Figure 16:
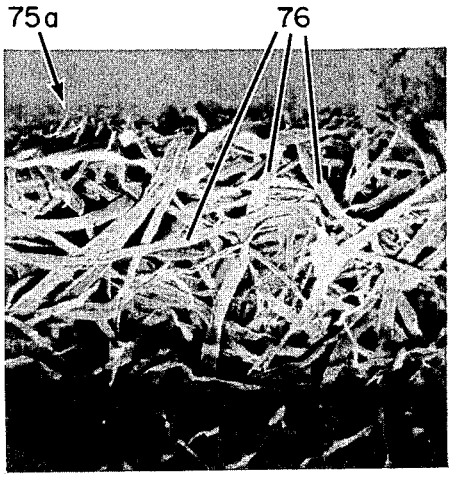

FIGS. 13 and 14 which are top oblique photographic views of sheets 70 and 70*a*, respectively, and FIGS. 15 and 16 which are bottom oblique photographic views of sheets 70 and 70*a*, respectively, further clearly illustrate the looseness (low density, large voids) of the structure of the creped and calendered sheet 70 relative to the tightly structured, uncreped and uncalendered sheet 70*a*.

Figure 17:
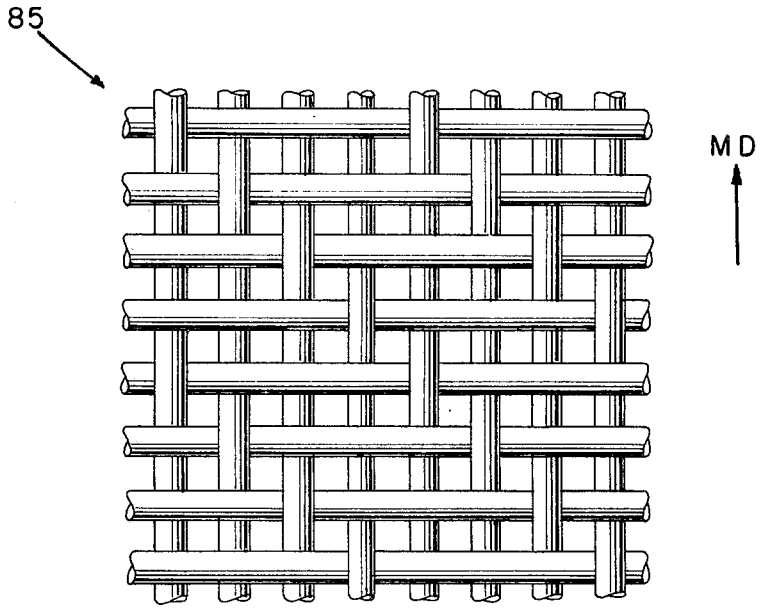
FIG. 17 is an enlarged scale, fragmentary plan view of the top surface (forming surface) of a 4-shed satin weave forming wire having long surface knuckles/-crossovers which extend in the cross machine direction when the fabric is installed in a papermaking machine such as shown in FIG. 2.

FIG. 17 is a fragmentary plan view of an exemplary Fourdrinier wire 85 which, when installed on a papermaking machine such as 80, FIG. 2, is suitable for making paper embodying the present invention. Such a Fourdrinier wire 85 preferably has a 110×95 or greater mesh (110 machine direction monofilaments per inch, and 95 cross machine direction monofilaments per inch) and is woven in the 4-shed weave illustrated in FIG. 17 so that the long (3-over) forming-surface crossovers extend in the cross machine direction.

Figure 18:
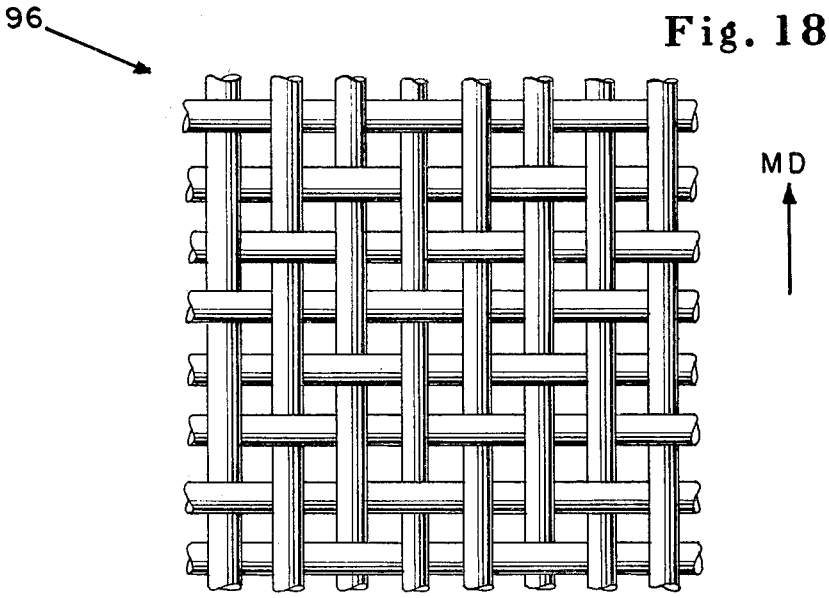
FIG. 18 is an enlarged scale, fragmentary plan view of the top surface (imprinting surface) of a 3-shed carrier fabric having two-over, one-under filaments extending in the machine direction when the fabric is installed in a papermaking machine such as shown in FIG. 2.

FIG. 18 is a fragmentary plan view of the outwardly facing surface of an exemplary foraminous carrier fabric such as identified by designator 96, FIG. 2. For practicing the present invention, foraminous carrier fabric 96 preferably is a semi-twill weave having a 73×60 mesh of monofilaments in which the long (2-over) outwardly facing crossovers extend in the machine direction.

FIG. 19 is a side elevational view of Yankee dryer 108, FIG. 2, having an enlarged-scale doctor blade 111 shown therewith for the purpose of clearly identifying the angular relations and features thereof, to wit: angle B is designated the bevel angle of the doctor blade 111; angle C is designated the back clearance angle; angle D is designated the creping impact angle; and angle A is the supplement to the creping impact angle D.

FIG. 20 is a side elevational view of a combining apparatus 120 for combining two rolls 116 of paper 70, FIG. 2, into 2-ply rolls 135 of 2-ply paper 134 which paper is amenable to subsequent converting into 2-ply tissue. Combining apparatus 120 comprises means not shown for synchronously unwinding 2 rolls 116 at predetermined speeds and tension, calender rolls 121 and 122, means not shown for controlling the calendering pressure between calender rolls 121 and 122, turning rolls 123, plybonding wheel 124, reel 127, and means not shown for controlling the speed, and draw of the 2-ply paper 134 being forwarded and wound into rolls 135 on cores 136 which are disposed on shaft 137.

FIG. 21 is a fragmentary sectional view of 2-ply paper 134 comprising 2 sheets of paper 70, FIG. 1, which have their long fiber layers 75 juxtaposed and which both have their velutinous top surfaces 72 facing outwardly.

HTR-Texture

Figure 22:
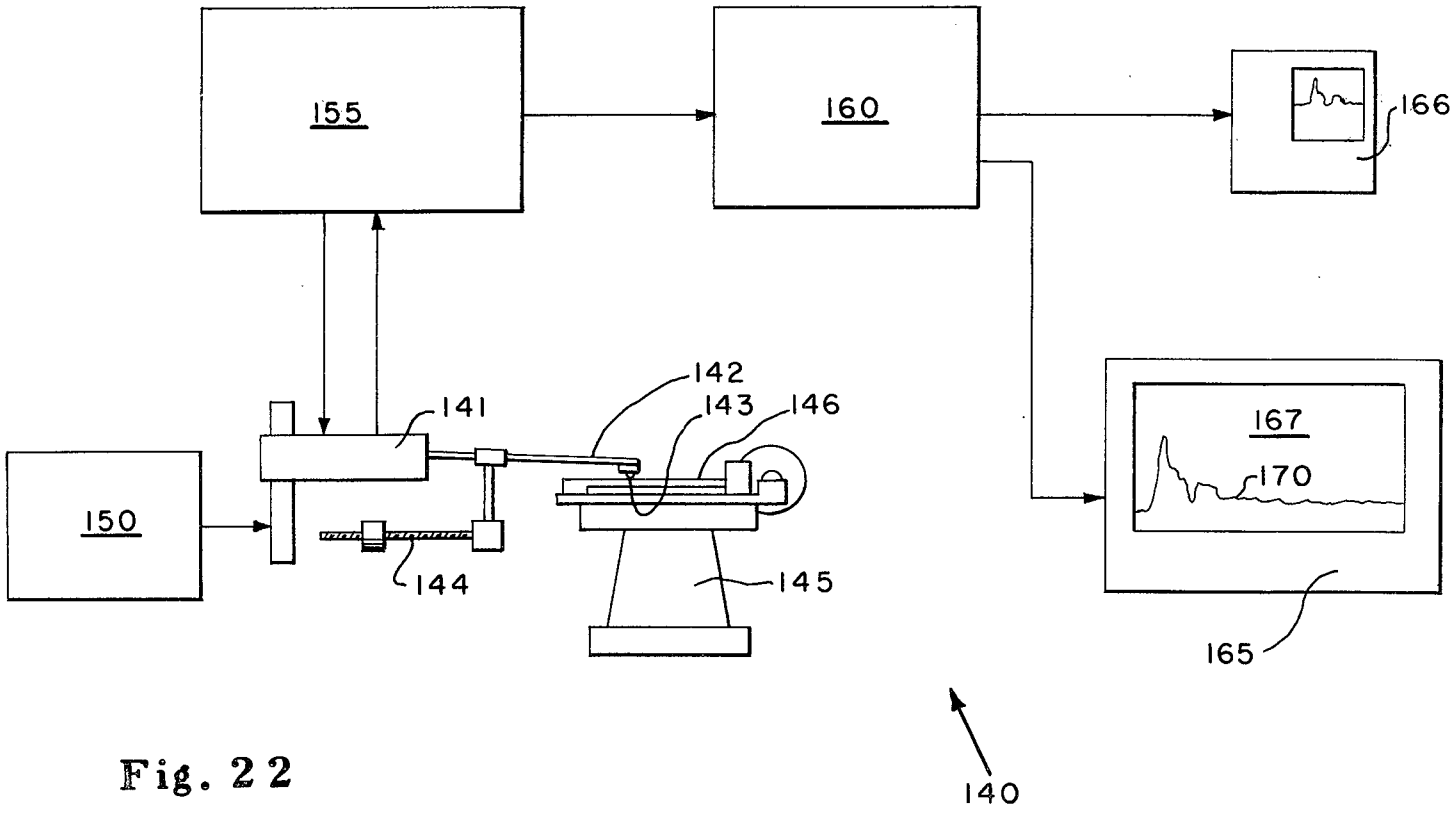
FIG. 22 is a somewhat schematic block diagram of an instrumentation system for quantitatively determining the average HTR-Texture of paper as described and defined hereinafter.

FIG. 22 is an instrumentation system 140 for quantitatively evaluating the texture of paper samples in terms of the population and amplitude of surface irregularities which are corporately referred to as texture. More particularly, the instrumentation system 140 is operated to provide a histogram-graph of the frequency spectrum and amplitudes of such texture irregularities in the most significant range of human tactile response: namely, in the frequency range of from 10 to 50 irregularities per lineal inch. The ultimate data is the integrated area of the X-Y plotted graph which lies between 10 and 50 cycles per inch, and above a base amplitude value of 0.1 mil. Because the units of the integrated area are mil-cycles per inch which are cumbersome units, the texture data is simply referred to as HTR-Texture: one unit of HTR-Texture being an integrated area of 1 mil-cycle per inch. Parenthetically, HTR is an pseudo acronym for human tactile response.

As shown in FIG. 22, the texture quantifying instrumentation system 140 comprises a probe assembly 141 having a stylus 142 having a twenty-thousandths-of-one-inch diameter hemispherical tip 143; means 144 for counterbalancing the stylus to provide a pressure of about 12.4 grams per square centimeter which is in the range of the pressure applied by a human who grasps a tissue or cloth between a thumb and forefinger to subjectively evaluate its softness; a sample drive table 145 which comprises means for moving a tissue paper sample 146 back and forth at a predetermined rate in the direction perpendicular to the sheet of paper upon which FIG. 22 is drawn; a stylus drive unit 150 for moving the probe assembly 141 left and right at a predetermined rate; a surface analyzer control unit 155, a frequency spectrum analyzer 160, an x-y plotter 165, and an optional oscilloscope 166. An x-y graph of the type generated by the system 140 is designated 167. It is this type of graph on which the x-axis is calibrated in cycles per lineal inch of stylus travel, and the y-axis is calibrated in mils, peak-to-peak vertical displacement of the stylus tip 143 which graph is subsequently measured, within predetermined boundaries, to integrate the area under the curve 170 to determine the average HTR-Texture of a paper sample 146.

The specific texture quantifying instrumentation system 140, FIG. 22, which was used to test the texture samples described herein comprises: the probe assembly 141 and the stylus drive unit 150 are combined in a Surfanalyzer 150 Drive No. 21-1410-01 which was procured from Gould Surfanalyzer Equipment, Federal Products, Providence, R.I.; the stylus 142 was also obtained from Federal Products as their part number 22-0132-00 for the stylus per se and part number 22-0129-00 which is an extension arm for the stylus per se; the sample drive table 145 is a Zeiss microscope frame and stage having a DC motor connected directly to the horizontal control shaft, and a rheostat for controlling the drive speed; the surface analyzer control unit 155 is a Surfanalyzer controller number 21-1330-20428 which was also procured from Federal Products; the frequency spectrum analyzer 160 is a Federal Scientific Ubiquitous Spectrum Analyzer Model UA-500-1 from Federal Scientific Corporation, New York, N.Y.; the oscilloscope 166 is a Tektronix Model T921; and the x-y recorder 165 is a Hewlett-Packard number 7044A. When operated, the stylus drive unit drives the stylus laterally at a rate of 0.1 inches per second (2.54 mm/second) while the sample 146 is moved orthogonally with respect to the lateral motion of the stylus at a rate of about 0.0025 inches per second (about 0.0635 mm/second) for a test period of 8 sweeps of the frequency analyzer which takes about 200 seconds. Thus, the texture data is derived from a relatively long zig-zag path across the sample which path has a total length of about 20 inches (about 51 cm).

Figure 23A:
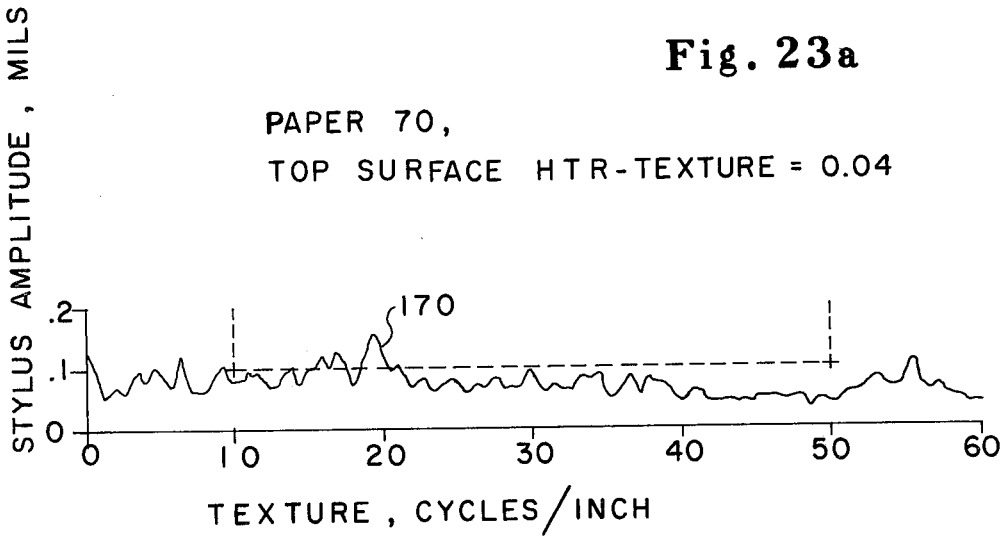
FIGS. 23*a* and 23*b* are X-Y plotted graphs of the spectral distribution of the surface irregularities of the top surfaces of samples of the paper shown in FIG. 11, 13, and 15 as determined by an instrumentation system such as that shown in FIG. 22.
Figure 23B:
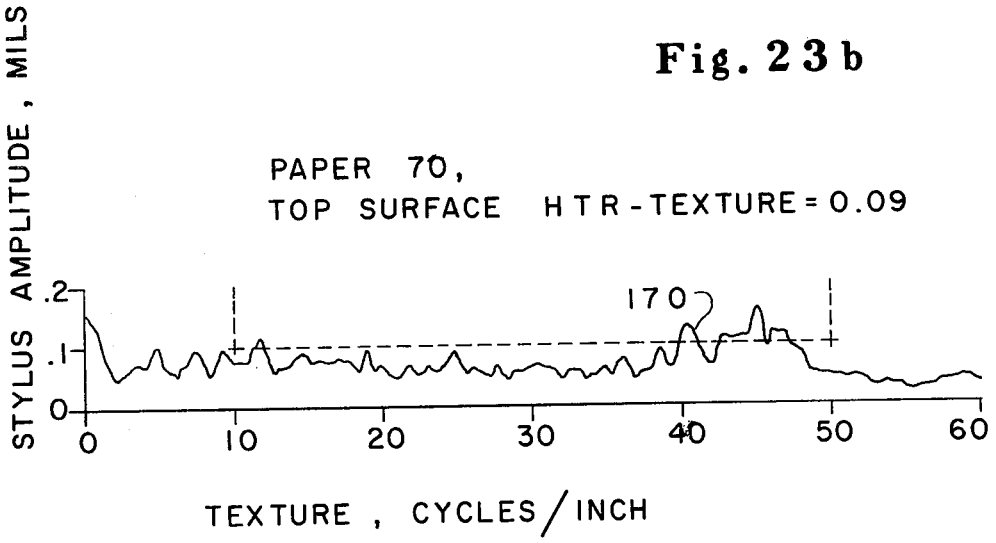

FIGS. 23*a* and 23*b* are x-y plots of plus 45 degree and minus 45 degree velutinous-surface (Yankee-surface) samples, respectively, of a 2-ply facial tissue product 134 comprising two paper sheets 70, FIG. 1, embodying the present invention which paper samples were taken from Example 1 described hereinafter, and which plots were obtained through the use of instrumentation system 140, FIG. 22. The sample graphed in FIG. 23*a* was determined to have an HTR-Texture (mils-cycles per lineal inch) of 0.04; the area under the curve 170 which lies between the dashed vertical lines at 10 and 50 cycles per lineal inch, and above a standard threshold base amplitude value of 0.1 mils which is indicated by the dashed horizontal line. Similarly, the HTR-Texture of the sample graphed in FIG. 23*b* was determined to have an HTR-Texture of 0.09. As is apparent from FIGS. 23*a* and 23*b*, the measured texture of different samples of the same paper exhibit some variance. Accordingly, average HTR-Textures are determined and reported to characterize the sample. Thus, the average HTR-Texture for this paper would be 0.07 (rounded to 2 digits).

Of course, more samples would normally be run to provide a statistically meaningful average having a reasonably small mean deviation. Indeed, as reported hereinafter, additional samples of Example 1 paper were run to provide an average HTR-Texture for Example 1, outside surfaces of finished 2-ply facial tissue product, of 0.07 with a standard deviation of 0.02.

FIG. 24 is a fragmentary plan view of a sample of paper sheet 70, FIG. 1, on which a plus 45 degree texture sample is designated 146*a* and on which a minus 45 degree texture sample is designated 146*b*. As shown, the length dimension of sample 146*a* is oriented at plus 45 degrees with respect to the machine direction (MD) of the paper 70; and the length dimension of sample 146*b* is minus 45 degrees with respect to the MD of the paper. Thus, the samples 146*a* and 146*b* are designated plus and minus 45 degree samples, respectively.

FIG. 25 is a fragmentary sectional view of a texture sample slide 180 comprising a glass slide 181 to which a paper sample 146 is attached with a double adhesive tape 182. Such a sample is prepared by scissoring the sample; placing its top-surface down on a clean table; and lightly pressing an adhesive tape covered slide 181 onto the back side of the paper sample. Only light pressure should be exerted to obviate error inducing changes in the paper sample 146.

FIG. 26 is a plan view of a texture sample slide 180, FIG. 25, upon which is indicated the zig-zag path 183 of stylus tip 143 when the sample slide 180 is tested in instrumentation system 140, FIG. 22. The zig-zag path 183 is precipitated by the simultaneous back or forth motion of the sample drive table 145 in the direction indicated by arrow 184, and the side-to-side motion imparted by the stylus drive unit 150, FIG. 22, which is indicated by arrow 185. The arrows 186 and 187 indicate the machine direction (MD) on the plus and minus 45 degree samples 146, respectively, as described above.

When one-ply tissue products are HTR-Texture tested, samples 146 and slides 180 are prepared so that the textures of both sides are averaged. When two-ply tissue products are HTR-Texture tested, single-ply samples 146 and slides 180 are normally prepared so that the textures of the outside surfaces of both plies are averaged. However, as later discussed with respect to Examples 1 through 5, and FIGS. 48 through 52, both sides of each ply may be measured and reported independently for such purposes as evidencing that the paper samples do indeed have two-sided characters: that is, for instance, a smooth velutinous side, and a textured side as shown in FIG. 38 which is described more fully hereinafter.

FIGS. 27*a* through 27*d* are Yankee-side HTR-Texture plots of samples of Example 3 (described hereinafter) paper which had been converted into 2-ply facial tissue, and which plots further illustrate the variance among a plurality of samples of the same paper; namely Example 3 described hereinafter. More specifically, FIGS. 27*a* and 27*c* are plus 45 degree samples having HTR-Texture values of 0.02 and 0.3, respectively; and FIGS. 27*b* and 27*d* are minus 45 degree samples having HTR-Texture values of 0.04 and 0.2 respectively.

FIGS. 28*a* and 28*b* are HTR-Texture plots of plus and minus 45 degree, off-Yankee-side samples, respectively, Example 3 paper (described hereinafter) which had also been converted into 2-ply facial tissues by combining, stretching, calendering, ply bonding, slitting, U-folding, and transverse cutting. The HTR-Texture values for FIGS. 28*a* and 28*b* are 1.3 and 0.8, respectively, which evidence, as compared to HTR-Texture values recited above for the Yankee-side samples shown in FIGS. 27*a* through 27*d*, that the Yankee-side samples are significantly less textured than the off-Yankee-side samples of the same paper.

FIGS. 29*a* and 29*b* are HTR-Texture plots of plus and minus 45 degree Yankee-side samples, respectively, of Example 3 paper which had been calendered and reeled at the dry end of the papermachine but which had not been converted into finished 2-ply tissue product. Thus, this paper had not been subjected to the stretching and calendering of the combining apparatus, FIG. 20, and other converting steps not illustrated. The HTR-Texture values for FIGS. 29*a* and 29*b* are 0.37 and 0.41, respectively, which average somewhat more than the average of 0.14 for the converted samples graphed in FIGS. 27*a* through 27*d* as described above. This evidences the efficacy with respect to reducing texture which is effected by the post papermaking calendering and stretching of combining and converting the paper to produce 2-ply facial tissues.

FIGS. 30*a* and 30*b* are HTR-Texture plots of plus and minus 45 degree off-Yankee-side samples, respectively, of a textured, short-long-short fiber 3-layer prior art toilet tissue paper of the type disclosed in the Morgan et al. patent which was described hereinbefore. These specific samples have HTR-Texture values of 2.8 and 3.3, respectively. More off-Yankee-side samples provided an overall average HTR-Texture of 3.3; and a plurality of Yankee-side samples of the same paper provided an HTR-Texture of 2.7. Thus, because the HTR-Texture for such a 3-layer, 1-ply tissue paper product is the average of both sides, the average HTR-Texture for this prior art tissue paper product was determined to be 3.0.

FFE-Index

Figure 34:
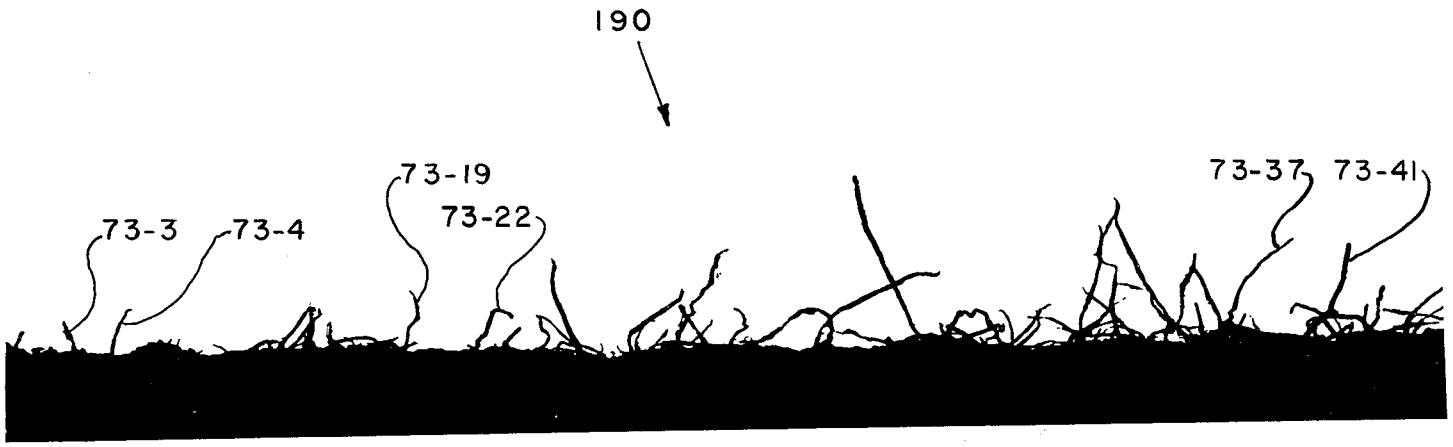
FIG. 34 is a photographic view of a portion of the top edge of an FFE-Index sample as viewed in the direction of the arrow on FIG. 33.
Figure 35:
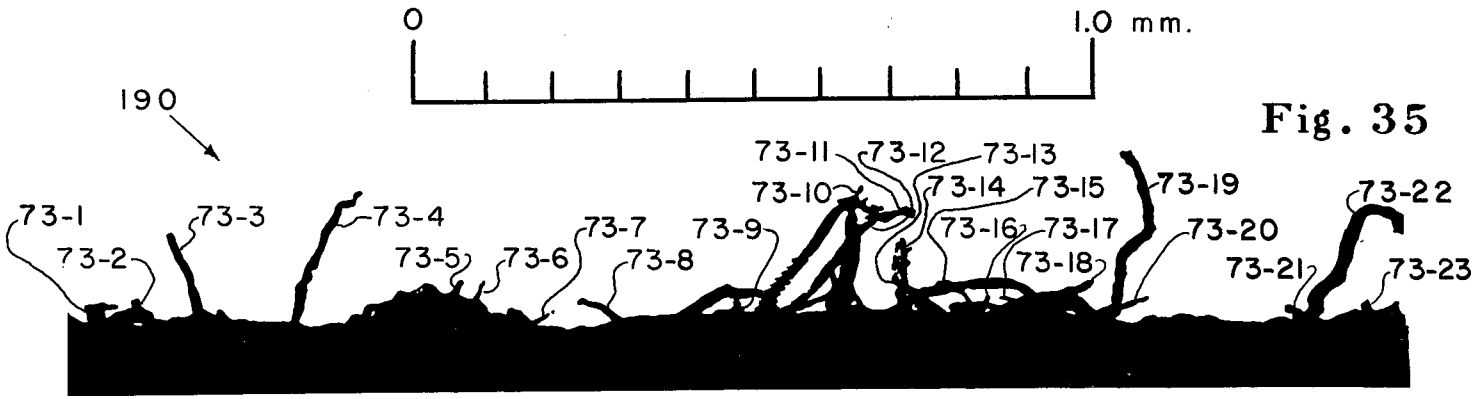
FIGS. 35 and 36 are photographic views of relatively sparse and dense free-fiber-end zones, respectively, of the FFE-Index sample of FIG. 34, and which zones are enlarged about 2.8× with respect to FIG. 34.
Figure 36:
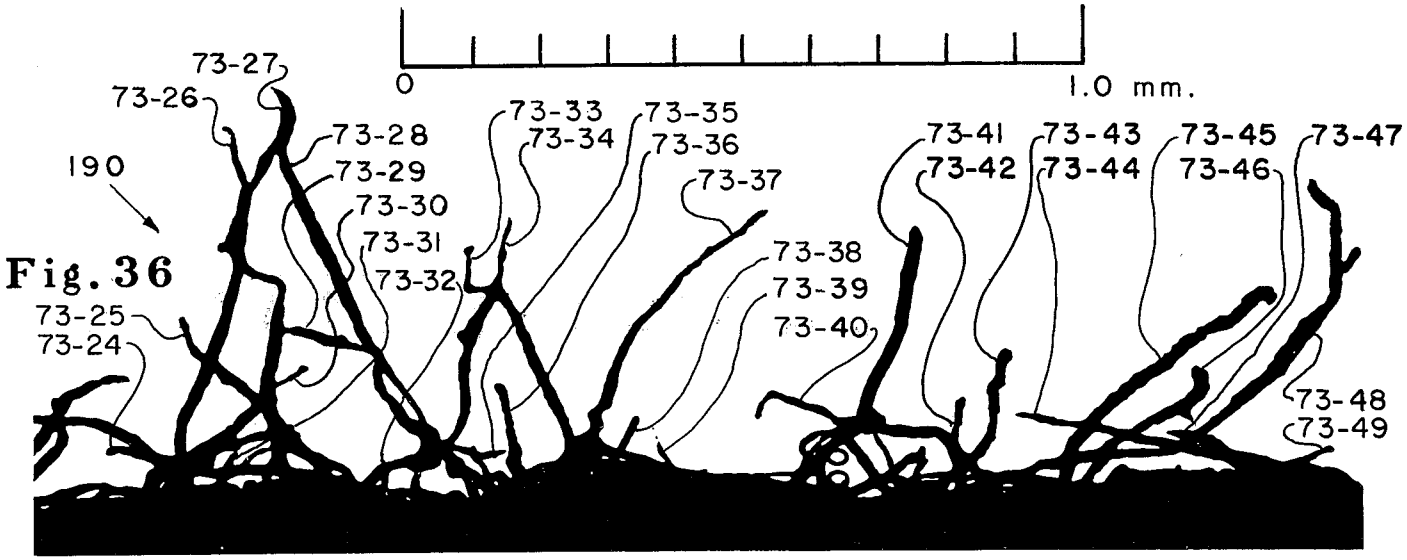

FIGS. 31, 32, and 33 illustrate the sequence of taking a sample 190 from a sheet of paper 70, FIG. 31; attaching the sample to the underside of a sled 191 and pulling the sled in the direction indicated by arrow 196 to move the sled across a brushing member 193 secured to a backing plate 194 of brushing apparatus 200; and making an FFE-Index Sample 201 by U-folding the sample 190 across the top end of a #1½ glass slide cover 197, and then securing that sub-assembly between two glass microscope slides 198, 198. As indicated in FIG. 33, when the FFE-Index Sample 201 is viewed in the direction indicated by arrow 199, the upstanding, unbonded free-fiber-ends 73 which corporately define the velutinous top surface 72 of paper 70, FIG. 1, can be counted. Such viewing is preferably done through an optical system having an adjustable focus in order to clearly identify each fiber to be counted: otherwise, for instance as when photographic silhouettes of the types shown in FIGS. 34–36 are used, some apparent ambiguity may exist with respect to which fiber end portions belong to which fiber base portions of fibers which cross such as fibers 73–33 and 73–34, FIG. 36. The count is made over a one-halfinch length (1.27 cm) of the top edge of the U-folded sample; only fibers which have a visible loose (unbonded) free end having a free-end length of 0.1 mm or greater are counted. Fibers which have no visible free end are not counted; neither are fibers having free-ends shorter than 0.1 mm counted. When the free-fiber-ends are counted according to these rules, the resulting number is the FFE-Index.

FIGS. 34 through 36 are fragmentary enlarged photosilhouettes of an FFE-Index Sample 201 having an FEE-Index of 126. The fiber-ends 73 of this sample have numerical suffixes from 1 through 49 which appear in numerical sequence from left to right in FIGS. 35 (fiber-ends 73-1 through 73-23) and 36 (fiber-ends 73-24 through 73-49). FIGS. 35 and 36 are enlarged portions of FIG. 34 which have been enlarged to better illustrate the nature of the velutinous surface of the paper sample and to clearly identify the counted fibers. Also, a one millimeter scale is provided for convenience on FIGS. 35 and 36. Some of the fibers of FIGS. 35 and 36 and also identified on the smaller scale FIG. 34 to facilitate reader orientation. It is apparent from these figures that the velutinous top surface 72 of the sample comprises non-uniform areas with respect to fiber free-end count and lengths. That is, the velutinous surface of the illustrated sample is not uniform in the nature of a cut pile rug. However, with respect to a human's tactile perceptiveness, such velutinous surfaces do in fact feel uniformly soft, smooth, and velvety. The lengths of the individually identified fibers on FIGS. 35 and 36 are tabulated for convenience on Tables Va and Vb, respectively.

Parenthetically, the brushing of paper samples 190 prior to assembling FFE-Index Samples 201, FIG. 33, is done with a unit pressure of about 5 grams per square centimeter which is a little less than about half of the average thumb-forefinger pressure applied by a human who is asked to feel a tissue or cloth to develop a subjective impression of its softness. This brushing sufficiently orients the free-fiber-ends in an upstanding disposition to facilitate counting them but care must be exerted to avoid breaking substantial numbers of interfiber bonds during the brushing inasmuch as that would precipitate spurious free-fiber-ends.

TABLE Va

Free (Unbonded) Fiber Ends, Lengths
Enlarged FFE-Index Sample
FIG. 35

| Fiber Designators, FIG. 35 | Length, mm Unbonded Upstanding End Portion Of Fiber |
|---|---|
| 73-1 | 0.05 |
| 73-2 | 0.03 |
| 73-3 | 0.12 |
| 73-4 | 0.24 |
| 73-5 | 0.02 |
| 73-6 | 0.03 |
| 73-7 | 0.04 |
| 73-8 | 0.07 |
| 73-9 | 0.05 |
| 73-10 | 0.23 |
| 73-11 | 0.34 |
| 73-12 | 0.23 |
| 73-13 | 0.13 |
| 73-14 | 0.11 |
| 73-15 | 0.08 |
| 73-16 | 0.03 |
| 73-17 | 0.03 |
| 73-18 | 0.09 |
| 73-19 | 0.28 |
| 73-20 | 0.08 |
| 73-21 | 0.02 |
| 73-22 | 0.28 |
| 73-23 | 0.02 |

TABLE Vb

Free (Unbonded) Fiber Ends, Lengths
Enlarged FFE-Index Sample
FIG. 36

| Fiber Designators, FIG. 36 | Length Unbonded Upstanding End Portion Of Fiber |
|---|---|
| 73-24 | 0.13 |
| 73-25 | 0.31 |
| 73-26 | 0.57 |
| 73-27 | 0.61 |
| 73-28 | 0.69 |
| 73-29 | 0.42 |
| 73-30 | 0.25 |
| 73-31 | 0.06 |
| 73-32 | 0.09 |
| 73-33 | 0.37 |
| 73-34 | 0.50 |
| 73-35 | 0.20 |
| 73-36 | 0.15 |
| 73-37 | 0.45 |
| 73-38 | 0.07 |
| 73-39 | 0.06 |
| 73-40 | 0.38 |
| 73-41 | 0.43 |
| 73-42 | 0.13 |
| 73-43 | 0.24 |
| 73-44 | 0.45 |
| 73-45 | 0.42 |
| 73-46 | 0.25 |
| 73-47 | 0.30 |
| 73-48 | 0.81 |
| 73-49 | 0.08 |

Alternate Paper Embodiments of Present Invention

Alternate paper embodiments of the present invention are shown in FIGS. 37, 38, and 39 and are identified by designators 210, 220, and 230 respectively. The various elements of these alternate embodiment papers which have counterparts in paper sheet 70, FIG. 1, are identically designated in order to simplify the descriptions. Alternate paper sheet 210, FIG. 37, is a 3-layer integrated structure comprising a predominantly long fibered, relatively high strength middle layer 75 which is sandwiched between and unified with two relatively low strength, smooth and soft outer layers 71 of predominantly flaccid short fibers. The short fibers of layers 71 have free-end-portions 73 which corporately define a velutinous surface 72 on each of the two sides of the paper sheet 210.

Alternate paper sheet 220, FIG. 38, is a 3-layer integrated structure wherein the top two layers as illustrated are, effectively, paper sheet 70, and the bottom layer 221 is a textured layer which preferably is predominantly comprised of relatively short papermaking fibers such as the fibers used to make top layer 71. However, whereas top layer 71 has a soft and smooth velutinous top surface as described and defined hereinbefore, bottom layer 221 has a textured outer surface 222; preferably texturized in the manner disclosed in the Morgan et al. patent which was referred to hereinbefore and which is hereby incorporated by reference.

Alternate paper embodiment 230, FIG. 39, is in fact a 2-ply tissue paper product comprising two plies of alternate paper 220 as described above and which have been combined in texture-side 222 to texture-side 222 relation so that both outer surfaces of the product are soft, smooth, and velutinous.

Alternate Foraminous Carrier Fabrics

Figure 40:
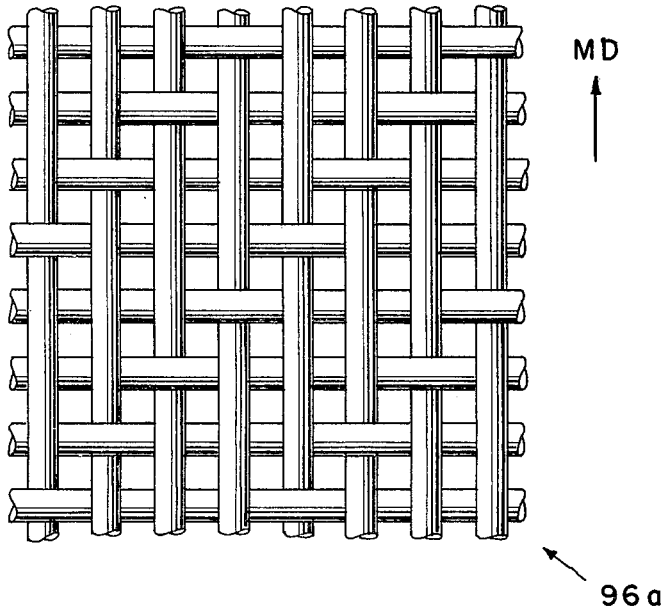
FIGS. 40 and 41 are fragmentary plan views of the top surfaces of alternate embodiment 4-shed and 5-shed satin weave carrier fabrics, respectively, in which the 3-over and 4-over filaments, respectively, extend in the machine direction of the papermaking machine.
Figure 41:
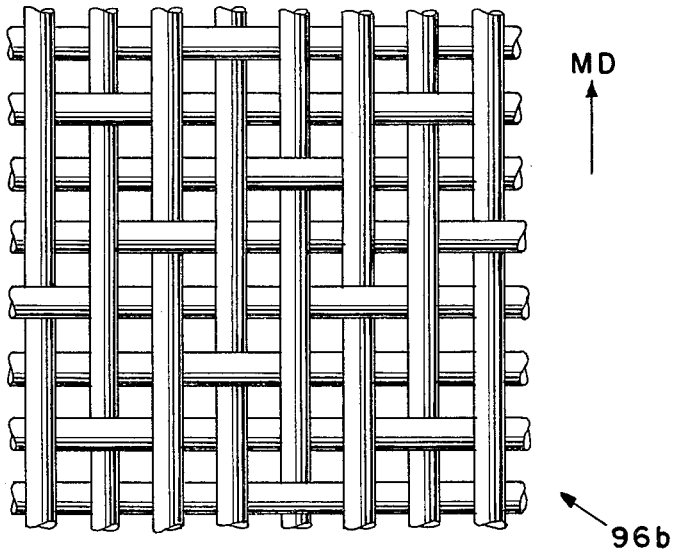

FIGS. 40 and 41 are fragmentary plan views of 4-shed and 5-shed satin weave carrier fabrics 96*a* and 96*b*, respectively, which can be used in place of the foraminous carrier fabric 96 on papermaking machine 80, FIG. 2, or the hereinafter described alternate papermaking machines having a carrier fabric 96 for the purpose of making paper embodying the present invention or by the process thereof. However, as compared to paper made through the use of the semi-twill carrier fabric 96 illustrated on FIG. 18, the higher shed count satin weaves progressively precipitate higher degrees of texture for identical mesh counts. Therefore, all other things being equal, to achieve a predetermined low level of texture, the 4-shed satin weave carrier fabric 96*a*, FIG. 40, would have to have a higher mesh count than the semi-twill carrier fabric 96, FIG. 18; and the 5-shed satin weave carrier fabric 96*b*, FIG. 41, would have to have an even higher mesh count than the fabric 96*a*. This texture effect of shed count is believed to be related to the effect the different crossover patterns and spacing have on creping frequency and character, all other things being equal.

Alternate Papermaking Machines

A number of papermaking machines are shown in side elevational views in FIGS. 42 through 47. While this is believed to be quite a comprehensive showing of alternate papermaking machines for practicing the present invention, it is not believed to be an exhaustive showing because of the myriad of papermaking machine configurations which are known to those skilled in the art. To simplify the descriptions of the several alternate papermaking machines, the components which have counterparts in papermaking machine 80, FIG. 2, are identically designated; and the alternate machines are described with respect to differences therebetween.

Figure 42:
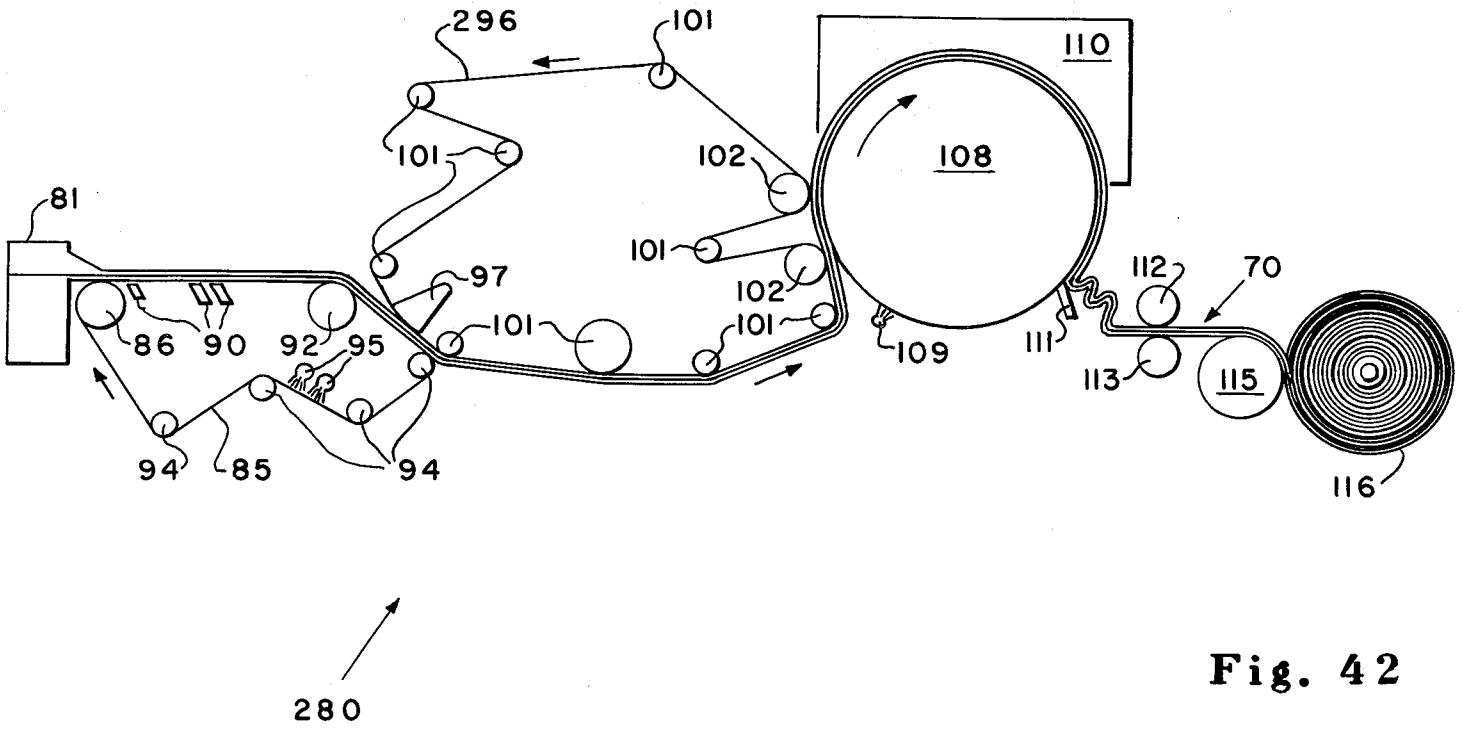
FIGS. 42 through 47 are somewhat schematic side elevational views of alternate embodiment papermaking machines.

Briefly, alternate papermaking machine 280, FIG. 42, is essentially different from papermaking machine 80, FIG. 2, by virtue of having a felt loop 296 in place of foraminous carrier fabric 96; by having two pressure rolls 102 rather than one; and by not having blow through dryers 100. Thus, the relatively high degree of pre-Yankee dryer dryness which can be achieved with blow through predrying is not believed to be critical to the present invention. Also, it is not believed to be essential to the present invention to avoid substantial mechanical pressing and/or compaction while relatively wet which avoidance is apparently critical to some of the prior art processes.

Figure 43:
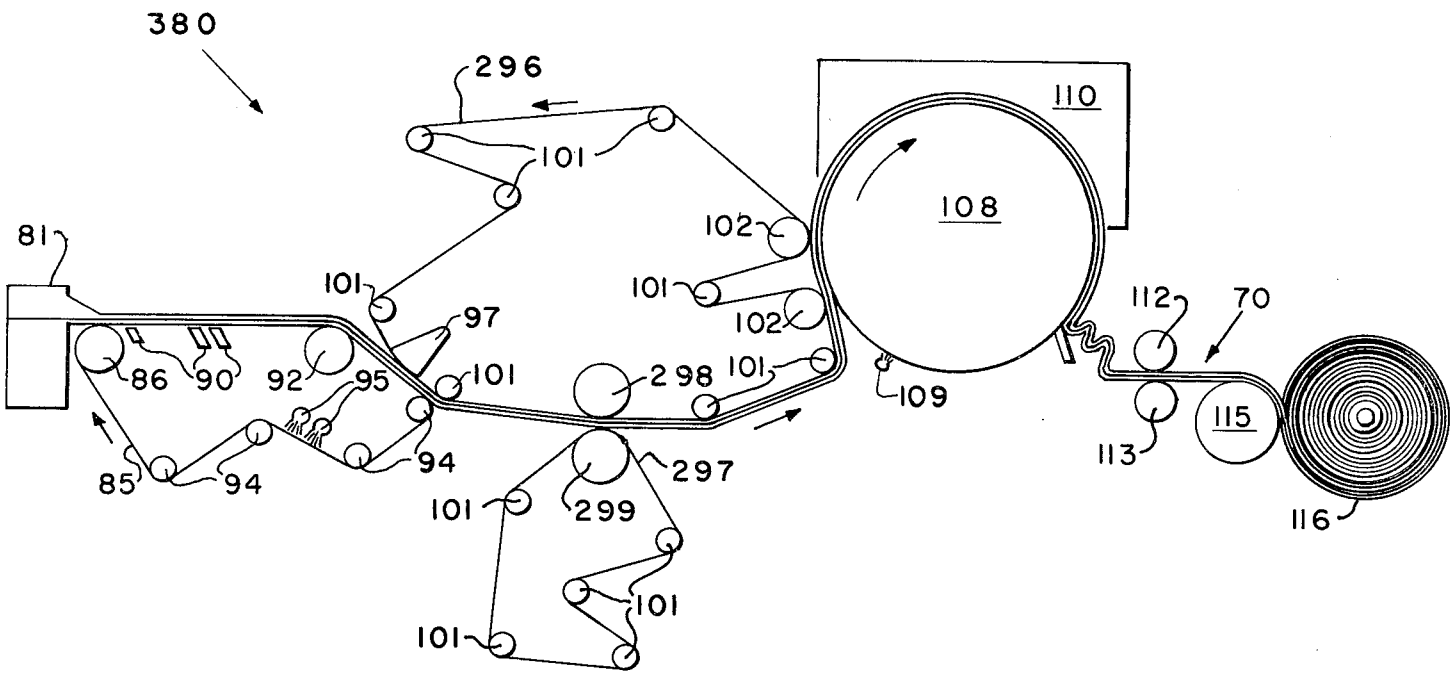

Alternate papermaking machine 380, FIG. 43, is like papermaking machine 280, FIG. 42, except it further comprises a lower felt loop 297 and wet pressing rolls 298 and 299 and means not shown for controllably biasing rolls 298 and 299 together. The lower felt loop 297 is looped about additional turning rolls 101 as illustrated. This alternate papermaking machine further illustrates that it is not believed to be essential to avoid substantial pressing and/or compaction of the paper web while it is relatively wet. While wet pressing is believed to in fact precipitate more compaction and hydrogen bonding, subsequent creping, calendering and crepe stretching in accordance with the present invention provides the smoothness and velutinous characteristics of paper embodying the present invention.

Figure 44:
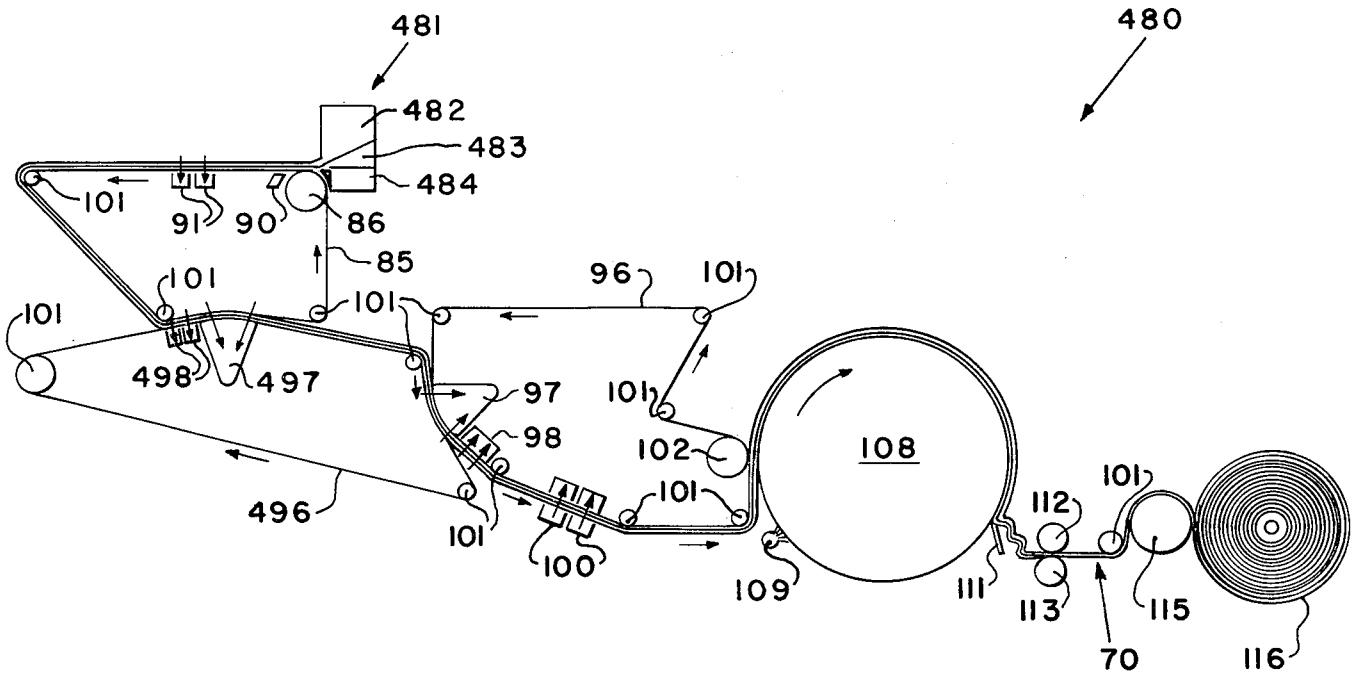

Alternate papermaking machine 480, FIG. 44, is functionally similar to papermaking machine 80, FIG. 2, except its headbox 481 has three chambers designated 482, 483 and 484 for adapting the machine 480 to make 2-layer or 3-layer paper; it further comprises an intermediate carrier fabric 496, an intermediate vacuum transfer box 497, additional vacuum dewatering boxes 498, and additional turning rolls 101 for guiding and supporting the loop of fabric 496. When operated to produce a 2-layer paper sheet having a predominantly short fiber layer on its Yankee-side, and a predominantly long fiber layer on its off-Yankee-side, a predominantly short fiber furnish is delivered from chamber 482, and a predominantly long fiber furnish is delivered simultaneously from chambers 483 and 484 which effectively causes headbox 481 to be a quasi 2-chamber headbox. Thus, the long fiber furnish is first on the Fourdrinier wire 85 and the short fiber furnish is delivered on top of the long fiber furnish. For a given Fourdrinier wire mesh, this provides a smoother embryonic fiber web than machine 80, FIG. 2, wherein the short fiber furnish is delivered onto the Fourdrinier wire in order for the Yankee-side of the paper to be the short fiber layer. Also, the embryonic web formed on the Fourdrinier wire of machine 480 undergoes two intermediate transfers prior to being transferred to the Yankee dryer 108: a first intermediate transfer precipitated by vacuum transfer box 497; and a second intermediate transfer precipitated by vacuum transfer box 97.

Figure 45:
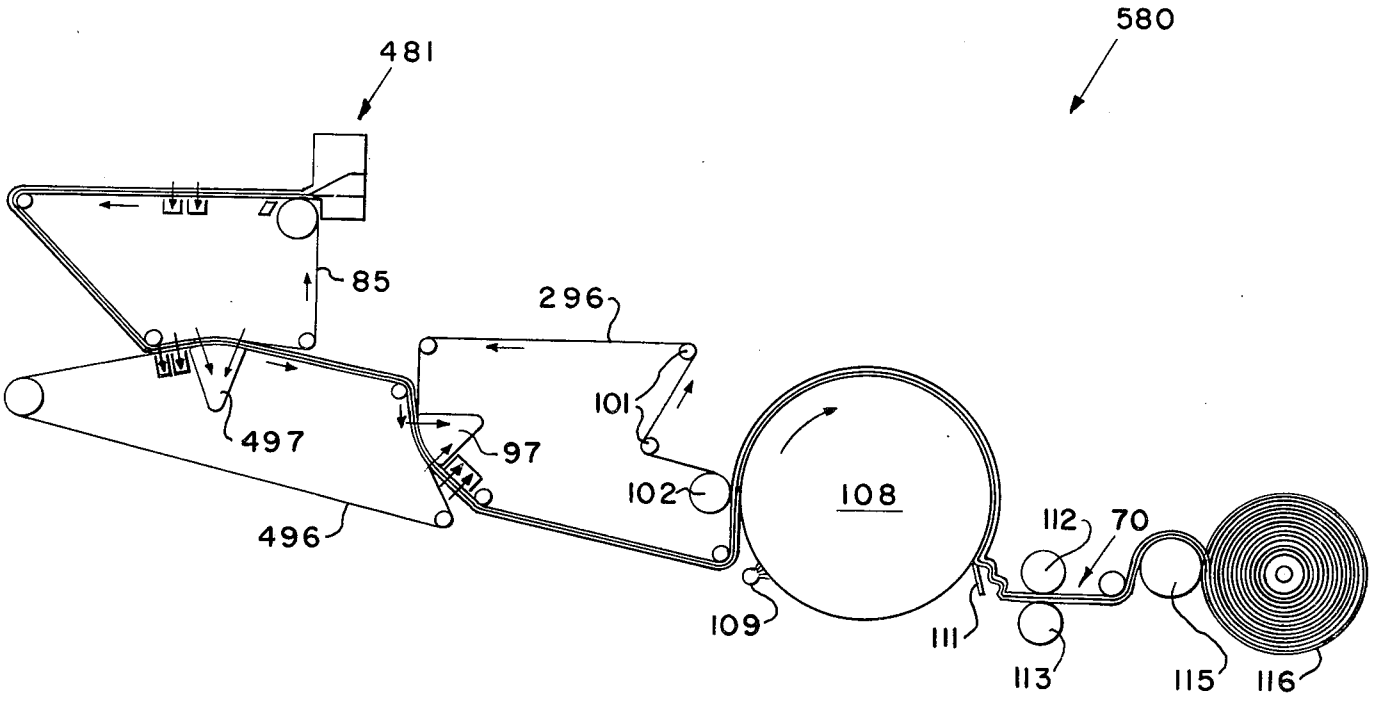

Alternate papermaking machine 580, FIG. 45, is substantially identical to papermaking machine 480, FIG. 44, except that machine 580 has a felt loop 296 in place of the foraminous carrier fabric 96 of machine 480, and machine 580 has no blow through predryers 100. Thus, machine 580 will normally deliver a relatively wetter web to its Yankee dryer 108 as compared to machine 480.

Figure 46:
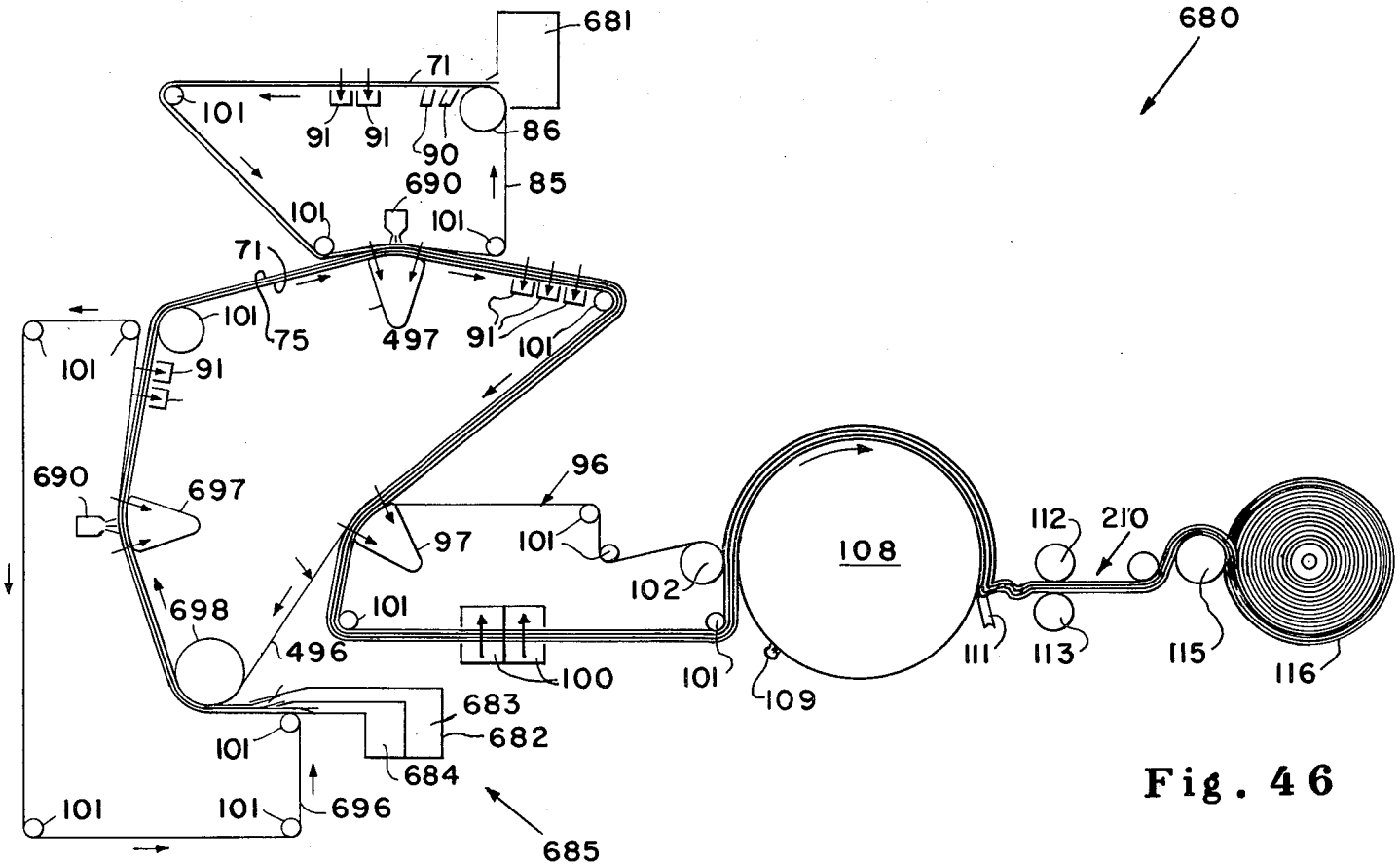

Alternate papermaking machine 680, FIG. 46, is of the general type shown in FIG. 17 of the Morgan et al. patent referenced hereinbefore which, when fitted with appropriate fine mesh fabrics and wires and when operated in accordance with the present invention is suitable for making 3-layer paper 210, FIG. 37, as described hereinbefore. As compared to machine 480, FIG. 44, machine 680 further comprises a twin wire former in the lower left corner of FIG. 46. Briefly, papermaking machine 680 comprises a single chamber headbox 681 for discretely forming a layer 71 which ultimately becomes the off-Yankee-side of the paper 210, and a twin wire former 685 comprising a twin headbox 682, carrier fabric 496 and Fourdrinier wire 696 for forming a 2-layer embroynic web comprising another layer 71 and a layer 75. The twin headbox is divided into two chambers 683 and 684. Optional steam or air jets 690 are provided to assist vacuum transfer boxes 497 and 697 to cause the discrete layer 71 to transfer from Fourdrinier wire 85 onto the 2-layer embryonic web, and for the 2-layer embryonic web to be forwarded on carrier fabric 496 from vacuum transfer box 697 to vacuum transfer box 97. Then, as the 2-layer embryonic web passes over vacuum transfer box 497, the discrete layer 71 is transferred onto the smooth upper surface of layer 75 from Fourdrinier wire 85. The 3-layer web is then predried, transferred to the Yankee dryer and so forth as previously described. This order of formation places the twin-wire formed layer 71 against the Yankee dryer surface so that it will most effectively have its interfiber bonds broken by the action of doctor blade 111. Subsequent calendering and stretching must be controlled sufficiently to provide the required smooth and velutinous character for top surface 72 of layer 71. Fourdrinier wires 85 and 696 are preferably 4-shed satin weaves having 110×95 meshes per inch and configured as shown in FIG. 17; and preferably carrier fabrics 96 and 496 are 3-shed semi-twill weaves having 73×60 meshes per inch and configured as shown in FIG. 18 although it is not intended to thereby limit the scope of the present invention.

Figure 47:
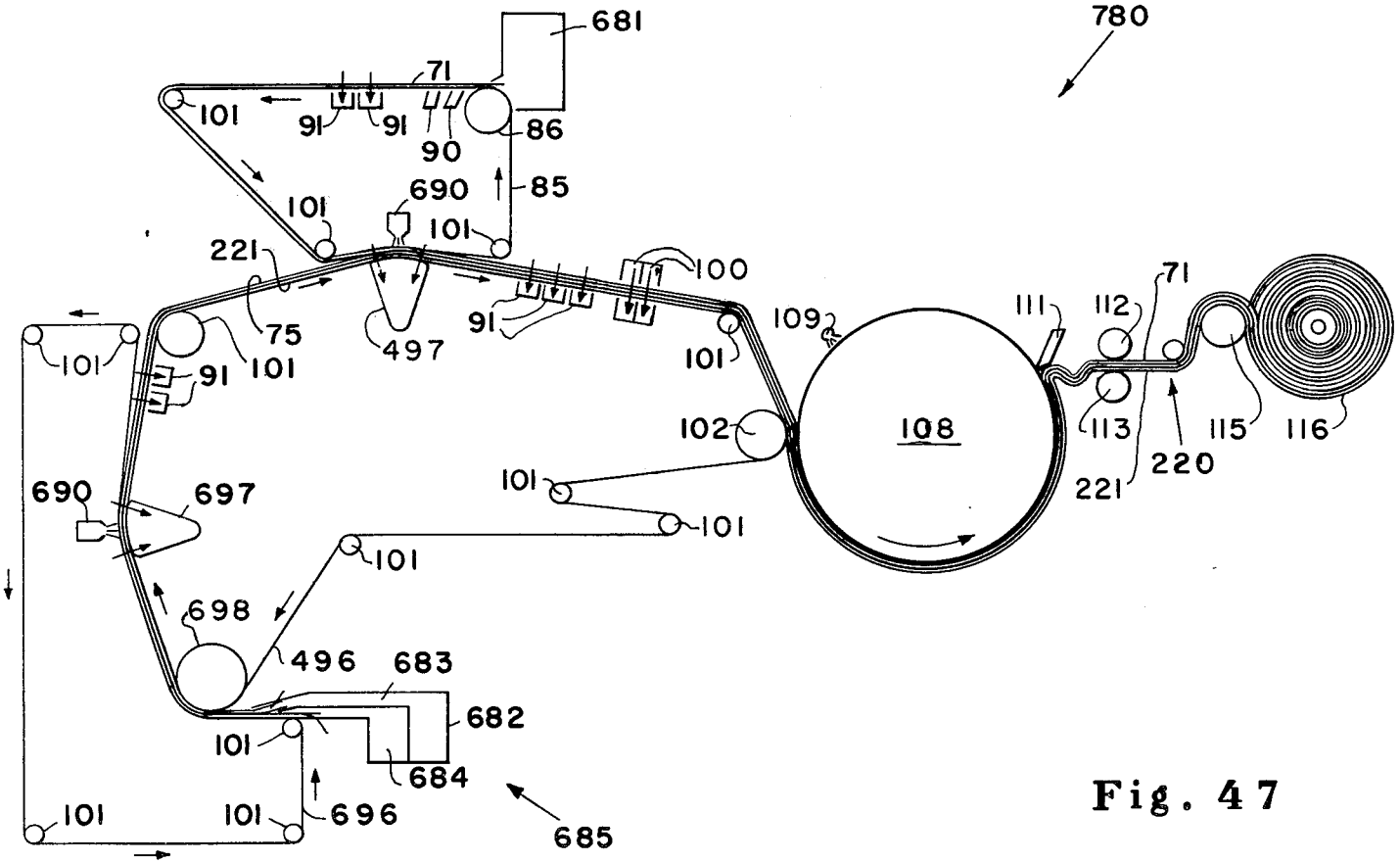
Figure 48:
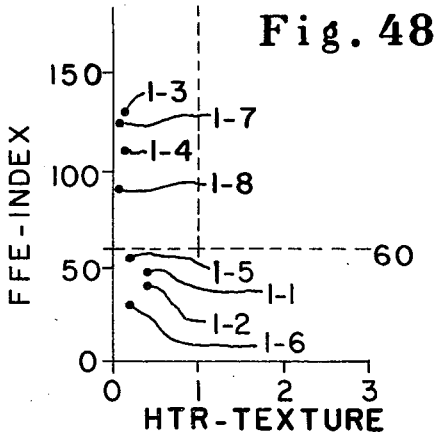
FIGS. 48 through 52 are graphs of HTR-Texture v. FFE-Index data taken from samples of Examples 1 through 5, respectively, which Examples are described hereinafter.
Figure 49:
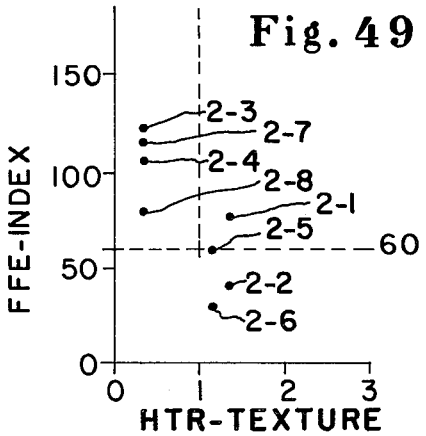
Figure 50:
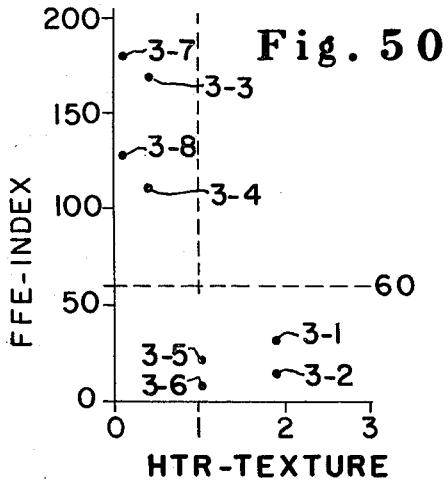
Figure 51:
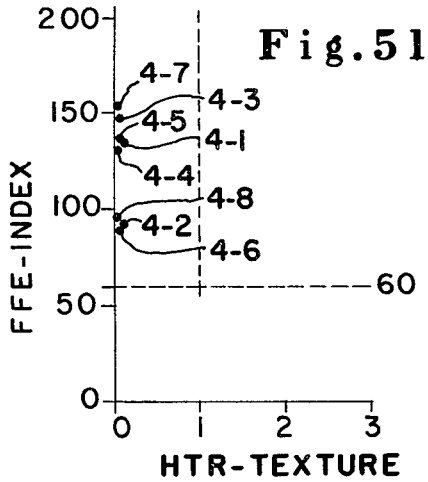
Figure 52:
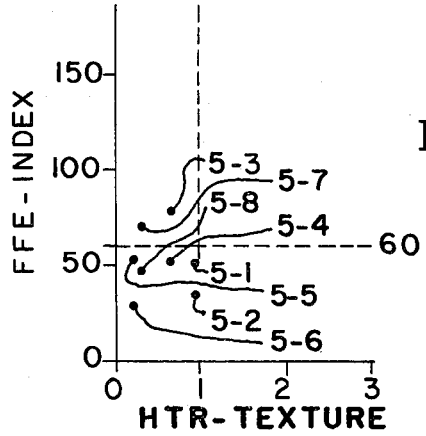

Alternate papermachine 780, FIG. 47, is a representative machine for making 3-layer paper 220, FIG. 38, having a textured bottom layer 221 and a smooth velutinous top layer 71. Machine 780 is similar to machine 680, FIG. 46, except for setting up the twin wire section to form an embryonic web having a short fiber layer 221 having discrete areas partially deflected into the interfilamentary spaces of carrier fabric 496, and a substantially flat, untextured long fiber layer 75. Fourdrinier wires 85 and 696 of papermaking machine 780 are preferably 4-shed satin weaves having 110×95 meshes per inch and configured as shown in FIG. 17; and preferably, to enable texturizing the predominantly short fiber layer 221, carrier fabric 496 has a 5-shed satin weave having about 31×25 meshes per inch and configured as shown in FIG. 41 although it is not intended to thereby limit the scope of the present invention.

EXAMPLE 1

A 2-layer paper sheet of the configuration shown in FIG. 1 was produced in accordance with the hereinbefore described process on a papermaking machine of the general configuration shown in FIG. 44 and identified thereon as papermaking machine 480. Briefly, a first fibrous slurry comprised primarily of short papermaking fibers was pumped through headbox chamber 482 and, simultaneously, a second fibrous slurry comprised primarily of long papermaking fibers was pumped through headbox chambers 483 and 484 and delivered in superposed relation onto the Fourdrinier wire 85 whereupon dewatering commenced whereby a 2-layer embryonic web was formed which comprised a short fiber layer on top of and integral with a long fiber layer. The first slurry had a fiber consistency of about 0.12% and its fibrous content comprised 25% by weight of Northern Hardwood Sulfite and 75% by weight of Eucalyptus Hardwood, the fibers of both of which have average lengths of about 0.8 mm. The first slurry also comprised about 0.1% by weight of fibers of Parez 631 NC wet strength additive which was procured from American Cyanamid. The second slurry had a fiber consistency of about 0.044% and its fibrous content was all Northern Softwood Kraft produced by the Buckeye Cellulose Company and having average fiber lengths of about 2.5 mm. Additionally, the second slurry also comprised about 1.5% by weight of fibers of Parez 631 NC, the above identified wet strength additive from American Cyanamid. The resulting paper web comprised a predominantly short fiber layer which constituted about 57% of the total basis weight of the web, and a long fiber layer which constituted about 43% of the total basis weight of the web. The purity of the short fiber layer upon which the ultimate benefits of the present invention depend greatly was determined to be 95%; not 100% because of the inability to totally preclude inter-slurry mixing in the superimposed headbox discharge streams and on the Fourdrinier wire 85. The other principal machine and process conditions comprised: Fourdrinier wire 85 was of the 4-shed, satin weave configuration shown on FIG. 17, and had 110 machine direction and 95 cross-machine-direction monofilaments per inch, respectively; the fiber consistency was about 8% when transferred from the Fourdrinier wire 85; the intermediate carrier fabric was also of the 4-shed, satin weave configuration shown in FIG. 17 and also had 110×95 (MD×CD) monofilaments per inch; the fiber consistency was increased toabout 22% prior to transfer to the foraminous carrier fabric 96; fabric 96 was of the monofilament polyester type of the configuration shown in FIG. 18 having a 3-shed semi-twill weave and 73×60 (MD×CD) monofilaments per inch; the diagonal free span of the foraminous carrier fabric 96 was 0.28 mm which is considerably less than the average long fiber length of 2.5 mm in the layer of the web disposed on the fabric 96 which substantially obviated displacing or bulking of the fibers of that layer into the interfilamentary spaces of the fabric 96; the fiber consistency was increased to a BPD (before predryer) value of about 29% just before the blow-through predryers 100 and, by the action of the predryers 100, to an APD (after predryer) value of about 52% prior to transfer onto the Yankee dryer 108; the transfer roll 102 was rubber covered having a P&J hardness value of 45 and was biased towards the Yankee dryer 108 at 440 pounds per lineal inch (pli); creping adhesive comprising a 0.25% aqueous solution of polyvinyl alcohol was spray applied by applicators 109 at a rate of 0.0012 ml per square centimeter of the Yankee dryer surface; the fiber consistency was increased to 98.5% before dry creping the web with doctor blade 111; doctor blade 111 had a bevel angle of 30 degrees and was positioned with respect to the Yankee dryer to provide an impact angle of about 90 degrees; the Yankee dryer was operated at about 800 fpm (feet per minute) (about 244 meters per minute); the top calender roll 112 was steel and the bottom calender roll 113 was rubber covered having a P&J hardness value of 30; the calender rolls 112 and 113 were biased together at 90 pli and operated at surface speeds of 617 fpm (about 188 meters per minute); and the paper was reeled at 641 fpm (about 195 meters per minute) to provide a draw of about 4% which resulted in a residual crepe of about 20%. This paper was subsequently combined and converted into 2-ply paper of the configuration shown in FIG. 21 through the use of a combining apparatus such as 120, FIG. 20. The top calender roll 121 was steel and the bottom calender roll 122 was rubber covered having a P&J hardness value of 95; and calender rolls 121 and 122 were biased together at 100 pli and operated at surface speeds of about 350 fpm (about 107 meters per minute). The 2-ply paper was reeled with a 1% draw. The physical properties of the 2-layer paper and the 2-ply paper product made therefrom are tabulated in Table VI.

TABLE VI

Example 1: Physical Properties of a 2-Layer/2-Ply Facial Tissue and the Paper From Which it was Produced

| Parameter | Paper Machine Reel Sample | Finished Product Sample | Basis | Units |
|---|---|---|---|---|
| Basis Weight | 19.0 | 18.6 | 2-Ply | lbs/3M ft$^2$ |
| Caliper | 22.1 | 17.6 | 4-Ply | mils |
| Bulk Density | 9.1 | 7.4 | 2-Ply | cm$^3$/gm |
| Tensile: | | | | |
| MD | 300 | 314 | 2-Ply | gm/in |
| CD | 211 | 193 | 2-Ply | gm/in |
| Total | 511 | 507 | 2-Ply | gm/in |
| Stretch: | | | | |
| MD | 21.1 | 15.5 | 2-Ply | gm/in |
| CD | 5.5 | 5.9 | 2-Ply | gm/in |
| Surface Purity: | | | | |
| Off-Yankee Side | 11 | 11 | — | % short fiber |
| Yankee Side | 95 | 95 | — | % short fiber |
| HTR-Texture Index: | | | | |
| Off-Yankee Side | 0.40 | 0.18 | — | mil-cycles per inch |
| Yankee Side | 0.14 | 0.07 | — | mil-cycles per inch |
| Free Fiber End Index: | | | | |
| Off-Yankee Side Brushed | 47 | 55 | — | None |
| Off-Yankee Side Unbrushed | 41 | 31 | — | None |
| Yankee Side Brushed | 130 | 124 | — | None |
| Yankee Side Unbrushed | 111 | 91 | — | None |
| Softness (Expert Panel) | — | +2.1 | A Contemporary 2-ply facial tissue | P.S.U. |

EXAMPLE 2

A 2-layer paper sheet of the configuration shown in FIG. 1 was produced in accordance with the hereinbefore described process on a papermaking machine of the general configuration shown in FIG. 44 and identified thereon as papermaking machine 480 except the paper was reeled without being calendered between calender rolls 112 and 113. Thus, as compared to reeled paper of Example 1, the reeled paper of Example 2 has relatively high HTR-Texture values. As compared to Example 1 which is well suited for facial tissue, the paper produced by Example 2 is well suited for use in toilet tissue products. Briefly, a first fibrous slurry comprised primarily of short papermaking fibers was pumped through headbox chamber 482 and, simultaneously, a second fibrous slurry comprised primarily of long papermaking fibers was pumped through headbox chambers 483 and 484 and delivered in superposed relation onto the Fourdrinier wire 85 whereupon dewatering commenced whereby a 2-layer embryonic web was formed which comprised a short fiber layer on top of and integral with a long fiber layer. The first slurry had a fiber consistency of about 0.15% and its fibrous content was Ecualyptus Hardwood, the fibers of which have average lengths of about 0.8 mm. The first slurry also comprised about 0.4% by weight of fibers of Accostrength 514, a dry strength additive supplied by American Cyanamid. The second slurry had a fiber consistency of about 0.063% and its fibrous content was all Northern Softwood Kraft produced by the Buckeye Cellulose Company and having average fiber lengths of about 2.5 mm. Additionally, the second slurry also comprised about 0.4% and 1.6% by weight of fibers of Accostrength 98 and Accostrength 514, respectively, which are dry strength additives from American Cyanamid. The resulting paper web comprised a predominantly short fiber layer which constituted about 55% of the total basis weight of the web, and a long fiber layer which constituted about 45% of the total basis weight of the web. The purity of the short fiber layer upon which the ultimate benefits of the present invention depend greatly was determined to be 97%. The other principal machine and process conditions comprised: Fourdrinier wire 85 was of the 4-shed, satin weave configuration shown on FIG. 17, and had 78 machine direction and 62 cross-machine-direction monofilaments per inch, respectively; the fiber consistency was about 8% when transferred from the Fourdrinier wire 85; the intermediate carrier fabric was also of the 4-shed, satin weave configuration shown in FIG. 17 and also had 78×62 (MD×CD); monofilaments per inch; the fiber consistency was increased to about 19% prior to transfer to the foraminous carrier fabric 96; fabric 96 was of the monofilament polyester type of the configuration shown in FIG. 41 having a 5-shed satin weave and 84×76 (MD×CD) filaments per inch; the diagonal free span of the foraminous carrier fabric 96 was 0.24 mm which is considerably less than the average long fiber length of 2.5 mm in the layer of the web disposed on the fabric 96 which substantially obviated displacing or bulking of the fibers of that layer into the interfilamentary spaces of the fabric 96; the fiber consistency was increased to a BPD value of about 32% just before the blow-through predryers 100 and, by the action of the predryers 100, to an APD value of about 53% prior to transfer onto the Yankee dryer 108; the transfer roll 102 was rubber covered having a P&J value of 45 and was biased towards the Yankee dryer 108 at 430 pounds per lineal inch (pli); creping adhesive comprising a 0.25% aqueous solution of polyvinyl alcohol was spray applied by applicators 109 at a rate of 0.00076 ml per square centimeter of the Yankee dryer surface; the fiber consistency was increased to 98.5% before dry creping the web with doctor blade 111; doctor blade 111 had a bevel angle of 30 degrees and was positioned with respect to the Yankee dyrer to provide an impact angle of about 90 degrees; the Yankee dryer was operated at about 800 fpm (feet per minute) (about 244 meters per minute); and the paper was reeled at 675 fpm (about 205 meters per minute) to provide about 16% crepe. This paper was subsequently combined into 2-ply paper of the configuration shown in FIG. 21 through the use of a combining apparatus such as 120, FIG. 20. However, the calender rolls 121 and 122 were not biased together. The 2-ply paper was reeled at about 200 fpm (about 61 meters per minute) with a 3% draw. The physical properties of the 2-layer paper and the 2-ply paper product made therefrom are tabulated in Table VII.

TABLE VII

Example 2: Physical Properties of a 2-Layer/2-Ply Toilet Tissue and the Paper From Which it was Produced

| Parameter | Paper Machine Reel Sample | Finished Product Sample | Basis | Units |
|---|---|---|---|---|
| Basis Weight | 20.3 | 20.5 | 2-Ply | lbs/3M $ft^2$ |
| Caliper | 14.5 | 13.2 | 2-Ply | mils |
| Bulk Density | 11.1 | 10.0 | 2-Ply | $cm^3$/gm |
| Tensile: | | | | |
| MD | 327 | 311 | 2-Ply | gm/in |
| CD | 274 | 258 | 2-Ply | gm/in |
| Total | 601 | 569 | 2-Ply | gm/in |
| Stretch: | | | | |
| MD | 20.9 | 20.9 | 2-Ply | % |
| CD | 5.5 | 5.7 | 2-Ply | % |
| Surface Purity: | | | | |
| Off-Yankee Side | 6 | 6 | — | % short fiber |
| Yankee Side | 97 | 97 | — | % short fiber |
| HTR-Texture Index: | | | | |
| Off-Yankee Side | 1.33 | 1.14 | — | mil-cycles per inch |
| Yankee Side | 0.31 | 0.31 | — | mil-cycles per inch |
| Free Fiber End Index: | | | | |
| Off-Yankee Side Brushed | 77 | 60 | — | None |
| Off-Yankee Side Unbrushed | 40 | 30 | — | None |
| Yankee Side Brushed | 122 | 115 | — | None |
| Yankee Side Unbrushed | 106 | 79 | — | None |
| Softness (Expert Panel) | — | +1.0 | A Contemporary 2-Ply facial tissue | P.S.U. |

EXAMPLE 3

A 2-layer paper sheet of the configuration shown in FIG. 1 was produced in accordance with the hereinbefore described process on a single-felt-loop papermaking machine of the general configuration shown in FIG. 45 and identified thereon as papermaking machine 580 except the paper was not calendered between calender rolls 112 and 113. Thus, relative to the reeled Example 1 paper, the reeled Example 3 paper is more highly textured. Briefly, a first fibrous slurry comprised primarily of short papermaking fibers was pumped through the top headbox chamber and, simultaneously, a second fibrous slurry comprised primarily of long papermaking fibers was pumped through the other two headbox chambers and delivered in superposed relation onto the Fourdrinier wire 85 whereupon dewatering commenced whereby a 2-layer embryonic web was formed which comprised a short fiber layer on top of and integral with a long fiber layer. The first slurry had a fiber consistency of about 0.11% and its fibrous content was Eucalyptus Hardwood Kraft, the fibers of which have average lengths of about 0.8 mm. The second slurry had a fiber consistency of about 0.047% and its fibrous content was all Northern Softwood Kraft produced by the Buckeye Cellulose Company and having average fiber lengths of about 2.5 mm. Additionally, the second slurry also comprised about 1.1% by weight of fibers of Parez 631 NC, a wet strength additive procured from Amerian Cyanamid. The resulting paper web comprised a predominantly short fiber layer which constituted about 55% of the total basis weight of the web, and a long fiber layer which constituted about 45% of the total basis weight of the web. The purity of the short fiber layer upon which the ultimate benefits of the present invention depend greatly was determined to be 94%. The other principal machine and process conditions comprised: Fourdrinier wire 85 was of the 4-shed, satin weave configuration shown on FIG. 17, and had 110 machine direction and 95 cross-machine-direction monofilaments per inch, respectively; the fiber consistency was about 8% when transferred from the Fourdrinier wire 85; the intermediate carrier fabric was also of the 4-shed, satin weave configuration shown in FIG. 17 and also had 110×95 (MD×CD) monofilaments per inch; the fiber consistency was increased to about 16% prior to transfer to the batt-on-mesh drying felt loop 296; the fiber consistency was increased to about 22% prior to transfer onto the Yankee dryer 108; the transfer roll 102 was rubber covered having a P&J value of 45 and was biased towards the Yankee dryer 108 at 480 pounds per lineal inch (pli); creping adhesive comprising a 0.27% aqueous solution of polyvinyl alcohol was spray applied by applicators 109 at a rate of 0.00079 ml per square centimeter of the Yankee dryer surface; the fiber consistency was increased to about 94% before dry creping the web with doctor blade 111; doctor blade 111 had a bevel angle of 30 degrees and was positioned with respect to the Yankee dryer to provide an impact angle of about 90 degrees; the Yankee dryer was operated at about 499 fpm (feet per minute) (about 152 meters per minute); and the paper was reeled at 389 fpm (about 119 meters per minute) to provide about 22% crepe. This paper was subsequently combined and converted into 2-ply paper of the configuration shown in FIG. 21 through the use of a combining apparatus such as 120, FIG. 20. The top calender roll 121 was steel and the bottom calender roll 122 was rubber covered having a P&J value of 50; and calender rolls 121 and 122 were biased together at 90 pli and operated at surface speeds of about 200 fpm (about 61 meters per minute). The 2-ply paper was reeled with a 3% draw. The physical properties of the 2-layer paper and the 2-ply paper product made therefrom are tabulated in Table VIII.

TABLE VIII

Example 3: Physical Properties of a 2-Layer/2-Ply Conventional Facial Tissue and the Paper From Which it was Produced

| Parameter | Paper Machine Reel Sample | Finished Product Sample | Basis | Units |
|---|---|---|---|---|
| Basis Weight | 17.8 | 18.6 | 2-Ply | lbs/3M ft$^2$ |
| Caliper | 24.4 | 20.7 | 4-Ply | mils |
| Bulk Density | 10.6 | 8.7 | 2-Ply | cm$^3$/gm |
| Tensile: | | | | |
| MD | 465 | 441 | 2-Ply | gm/in |
| CD | 209 | 195 | 2-Ply | gm/in |
| Total | 674 | 636 | 2-Ply | gm/in |
| Stretch: | | | | |
| MD | 24.1 | 17.3 | 2-Ply | % |
| CD | 6.7 | 6.3 | 2-Ply | % |
| Surface Purity: | | | | |
| Off-Yankee Side | 10 | 10 | — | % short fiber |
| Yankee Side | 94 | 94 | — | % short fiber |
| HTR-Texture Index: | | | | |
| Off-Yankee Side | 1.89 | 1.03 | — | mil-cycles per inch |
| Yankee Side | 0.40 | 0.10 | — | mil-cycles per inch |
| Free Fiber End Index: | | | | |
| Off-Yankee Side Brushed | 32 | 22 | — | None |
| Off-Yankee Side Unbrushed | 14 | 8 | — | None |
| Yankee Side Brushed | 168 | 179 | — | None |
| Yankee Side Unbrushed | 110 | 128 | — | None |
| Softness (Expert Panel) | — | +1.7 | A Contemporary 2-Ply facial tissue | P.S.U. |

EXAMPLE 4

A 3-layer paper sheet of the configuration shown in FIG. 37 was produced in accordance with the hereinbefore described process on a papermaking machine of the general configuration shown in FIG. 44 and identified thereon as papermaking machine 480. Briefly, a first fibrous slurry comprised primarily of short papermaking fibers was pumped through headbox chambers 482 and 484 and, simultaneously, a second fibrous slurry comprised primarily of long papermaking fibers was pumped through headbox chamber 483 and delivered in superposed relation onto the Fourdrinier wire 85 whereupon dewatering commenced whereby a 3-layer embryonic web was formed which comprised short fiber layers on top of and beneath and integral with a long fiber layer. The first slurry had a fiber consistency of about 0.11% and its fibrous content Eucalyptus Hardwood Kraft, the fibers of which have average lengths of about 0.8 mm. The second slurry had a fiber consistency of about 0.15% and its fibrous content was all Northern Softwood Kraft produced by the Buckeye Cellulose Company and having average fiber lengths of about 2.5 mm. Additionally, the second slurry also comprised about 0.4% by weight of fibers of Parez 631 NC, which was procured from American Cyanamid. The resulting paper web comprised a predominantly short fiber top layer (Yankee-side) which constituted about 30% of the total basis weight of the web, a long fiber middle layer which constituted about 40% of the total basis weight of the web, and a short fiber bottom layer (off-Yankee-side) which constituted about 30% of the total basis weight of the web. The short fiber purity of the top and bottom short fiber layers upon which the ultimate benefits of the present invention depend greatly was determined to be 99% and 98%, respectively. The other principal machine and process conditions comprised: Fourdrinier wire 85 was of the 4-shed, satin weave configuration shown on FIG. 17, and had 110 machine direction and 95 cross-machine-direction monofilaments per inch, respectively; the fiber consistency was estimated to be about 8% when transferred from the Fourdrinier wire 85; the intermediate carrier fabric was also of the 4-shed, satin weave configuration shown in FIG. 17 and also had 110×95 (MD×CD) monofilaments per inch; the fiber consistency was estimated to have increased to about 22% prior to transfer to the foraminous carrier fabric 96; fabric 96 was of the monofilament polyester type of the configuration shown in FIG. 40 having a 4-shed satin weave and 110×95 (MD×CD) monofilaments per inch; the diagonal free span of the foraminous carrier fabric 96 was 0.17 mm which is considerably less than the average short fiber length of 0.8 mm in the layer of the web disposed on the fabric 96 which substantially obviated displacing or bulking of the fibers of that layer into the interfilamentary spaces of the fabic 96; the fiber consistency was increased to an estimated BPD value of about 27% just before the blow-through predryers 100 and, by the action of the predryers 100, to an estimated APD value of about 60% prior to transfer onto the Yankee dryer 108; the transfer roll 102 was rubber covered having a P&J value of 45 and was biased towards the Yankee dryer 108 at 450 pounds per lineal inch (pli); creping adhesive comprising a 0.25% aqueous solution of polyvinyl alcohol was spray applied by applicators 109 at a rate of 0.00082 ml per square centimeter of the Yankee dryer surface; the fiber consistency was increased to an estimated 99% before dry creping the web with doctor blade 111; doctor blade 111 had a bevel angle of 30 degrees and was positioned with respect to the Yankee dryer to provide an impact angle of about 90 degrees; the Yankee dryer was operated at about 800 fpm (feet per minute) (about 244 meters per minute); the top calender roll 112 was steel and the bottom calender roll 113 was rubber covered having a P&J value of about 50; calender rolls 112 and 113 were biased together at 90 pli and operated at surface speeds of 659 fpm (about 200 meters per minute); and the paper was reeled at 670 fpm (about 204 meter per minute) which resulted in a residual crepe of about 16.3%. This paper was subsequently further stretched, calendered, and converted into finished 1-ply, 3-layer facial tissue during which it was calendered at 190 pli at 200 fpm (about 61 meters per minute) and about 3% draw. The physical properties of the 3-layer paper and the 1-ply paper product made therefrom are tabulated in Table IX.

TABLE IX

Example 4: Physical Properties of a 3-Layer/1-Ply Facial Tissue and the Paper From Which it was Produced

| Parameter | Paper Machine Reel Sample | Finished Product Sample | Basis | Units |
|---|---|---|---|---|
| Basis Weight | 16.9 | 16.8 | 2-Ply | lbs/3M ft$^2$ |
| Caliper | 13.3 | 11.7 | 2-Ply | mils |
| Bulk Density | 6.2 | 5.5 | 1-Ply | cm$^3$/gm |
| Tensile: | | | | |
| MD | 370 | 368 | 2-Ply | gm/in |
| CD | 203 | 228 | 2-Ply | gm/in |
| Total | 573 | 596 | 2-Ply | gm/in |
| Stretch: | | | | |
| MD | 23.5 | 19.1 | 2-Ply | % |
| CD | 4.0 | 4.4 | 2-Ply | % |
| Surface Purity: | | | | |
| Off-Yankee Side | 98 | 98 | — | % short fiber |
| Yankee Side | 99 | 99 | — | % short fiber |
| HTR-Texture Index: | | | | |
| Off-Yankee Side | 0.09 | 0.06 | — | mil-cycles per inch |
| Yankee Side | 0.06 | 0.04 | — | mil-cycles per inch |
| Free Fiber End Index: | | | | |
| Off-Yankee Side Brushed | 135 | 137 | — | None |
| Off-Yankee Side Unbrushed | 91 | 89 | — | None |
| Yankee Side Brushed | 147 | 154 | — | None |
| Yankee Side Unbrushed | 131 | 96 | — | None |
| Softness (Expert Panel) | — | +0.3 | A Contemporary 2-Ply facial tissue | P.S.U. |

EXAMPLE 5

A 2-layer facial tissue paper sheet of the configuration shown in FIG. 1 was produced in accordance with the hereinbefore described process on a papermaking machine of the general configuration shown in FIG. 2 and identified thereon as papermaking machine 80. Briefly, a first fibrous slurry comprised primarily of short papermaking fibers was pumped through headbox chamber 82 and, simultaneously, a second fibrous slurry comprised primarily of long papermaking fibers was pumped through headbox chamber 83 and delivered in superposed relation onto the Fourdrinier wire 85 whereupon dewatering commenced whereby a 2-layer embryonic web was formed which comprised a short fiber layer on top of and integral with a long fiber layer. The first slurry had a fiber consistency of about 0.13% and its fibrous content comprised 50% by weight of Northern Hardwood Sulfite and 50% by weight of Eucalyptus Hardwood Kraft, the fibers of both having average lengths of about 0.8 mm. The first slurry also comprised about 0.15% of its fiber weight of Parez 631 NC, a wet strength additive which was procured from American Cyanamid. Also, the first slurry contained about 0.25% by weight of fibers of Accostrength 514, a potentiating agent which was also procured from American Cyanamid. The second slurry had a fiber consistency of about 0.14% and its fibrous content was all Northern Softwood Kraft produced by the Buckeye Cellulose Company and having average fiber lengths of about 2.5 mm. Additionally, the second slurry also comprised about 0.24% by weight of fibers of Parez 631 NC, the above identified wet strength additive from American Cyanamid. The resulting paper web comprised a predominantly short fiber layer which constituted about 55% of the total basis weight of the web, and a long fiber layer which constituted about 45% of the total basis weight of the web. The purity of the short fiber layer upon which the ultimate benefits of the present invention depend greatly was determined to be 91%. The other principal machine and process conditions comprised: Fourdrinier wire 85 was of the 4-shed, satin weave configuration shown on FIG. 17, and had 110 machine direction and 95 cross-machine-direction monofilaments per inch, respectively; the fiber consistency was estimated to be about 15 to 18% when transferred from the Fourdrinier wire 85 to the foraminous carrier fabric 96; fabric 96 was of the monofilament polyester type of the configuration shown in FIG. 18 having a 3-shed semi-twill weave and 73×60 (MD×CD) monofilaments per inch; the diagonal free span of the foraminous carrier fabric 96 was 0.28 mm which is considerably less than the average long fiber length of 2.5 mm in the layer of the web disposed on the fabric 96 which substantially obviated displacing or bulking of the fibers of that layer into the interfilamentary spaces of the fabric 96; the fiber consistency was increased to a BPD value of about 23% just before the blow-through predryers 100 and, by the action of the predryers 100, to an APD value of about 59% prior to transfer onto the Yankee dryer 108; the transfer roll 102 was rubber covered having a P&J value of 41 and was biased towards the Yankee dryer 108 at 490 pounds per lineal inch (pli); creping adhesive comprising a 0.53% aqueous solution of 40% polyvinyl alcohol and 60% Peter Cooper IX animal base glue was spray applied by applicators 109 at a rate of 0.00048 ml per square centimeter of the Yankee dryer surface; the fiber consistency was increased to 96.8% before dry creping the web with doctor blade 111; doctor blade 111 had a bevel angle of 27 degrees and was positioned with respect to the Yankee dryer to provide an impact angle of about 81 degrees; the Yankee dryer was operated at about 2600 fpm (feet per minute) (about 791 meters per minute); the top calender roll 112 was steel and the bottom calender roll 113 was rubber covered having a P&J value of 47; calender rolls 112 and 113 were biased together at 65 pli and operated at surface speeds of 1996 fpm (about 607 meters per minute); and the paper was reeled at 2083 fpm (about 634 meters per minute) to provide a residual crepe of about 20%. This paper was subsequently combined and converted into 2-ply paper of the configuration shown in FIG. 21 through the use of a combining apparatus such as 120, FIG. 20. The top calender roll 121 was steel and the bottom calender roll 122 was rubber covered having a P&J value of 95; and calender rolls 121 and 122 were biased together at 100 pli and operated at surface speeds of about 350 fpm (about 107 meters per minute). The 2-ply paper was reeled with a 4% draw. The physical properties of the 2-layer paper and the 2-ply paper product made therefrom are tabulated in Table X.

While the papermaking machine 80, FIG. 2, was only involved in making Example 5, it is believed that the benefits of the present invention can be realized most efficiently and economically on such a machine although it is not intended to thereby limit the scope of the present invention.

TABLE X

Example 5: Physical Properties of a 2-Layer/2-Ply Facial Tissue and the Paper From Which it was Produced

| Parameter | Paper Machine Reel Sample | Finished Product Sample | Basis | Units |
|---|---|---|---|---|
| Basis Weight | 19.4 | 18.6 | 2-Ply | lbs/3M ft$^2$ |
| Caliper | 25.8 | 19.6 | 4-Ply | mils |
| Bulk Density | 10.4 | 8.3 | 2-Ply | cm$^3$/gm |
| Tensile: | | | | |
| MD | 339 | 310 | 2-Ply | gm/in |
| CD | 197 | 196 | 2-Ply | gm/in |
| Total | 536 | 506 | 2-Ply | gm/in |
| Stretch: | | | | |
| MD | 28.3 | 16.6 | 2-Ply | % |
| CD | 7.3 | 7.0 | 2-Ply | % |
| Surface Purity: | | | | |
| Off-Yankee Side | 14 | 14 | — | % short fiber |
| Yankee Side | 91 | 91 | — | % short fiber |
| HTR-Texture Index: | | | | |
| Off-Yankee Side | 0.95 | 0.22 | — | mil-cycles per inch |
| Yankee Side | 0.65 | 0.30 | — | mil-cycles per inch |
| Free Fiber End Index: | | | | |
| Off-Yankee Side Brushed | 52 | 53 | — | None |
| Off-Yankee Side Unbrushed | 35 | 29 | — | None |
| Yankee Side Brushed | 78 | 71 | — | None |
| Yankee Side Unbrushed | 52 | 47 | — | None |
| Softness (Expert Panel) | — | +0.5 | A Contemporary 2-Ply facial tissue | P.S.U. |

For convenience, the HTR-Texture v. FFE-Index data for Examples 1 through 5 are plotted on FIGS. 48 through 52, respectively, and tabulated together in Table XIa. Each of the data point designators comprises two numbers separated by a hyphen: the number to the left of the hyphen is the Example number (i.e., 1, 2, 3, 4, or 5); and, the numbers to the right of the hyphen were assigned according to the key listed in Table XIb. Briefly, in general, the graphs indicate: the two-sided nature of the two-layer Example 1, 2, 3, and 5 of paper 70: that is, that their Yankee-sides are substantially different from their off-Yankee sides inasmuch as, in general, their Yankee-sides have substantially higher FFE-Index values and lower HTR-Texture values than their off-Yankee-sides; and that both the Yankee-side and the off-Yankee side of the 3-layer Example 4, FIG. 37, have relatively high FFE-Index values and low HTR-values which indicate that both outer surfaces of such paper and the products made therefrom are smooth, soft and velutinous: the hallmarks of paper embodying the present invention.

TABLE XIa

HTR-Texture v. FFE-Index
5 Examples of Present Invention Tissue Paper & Products
Reference FIGS. 48–52

| | | Yankee Side | | | Off-Yankee Side | | |
|---|---|---|---|---|---|---|---|
| | | | FFE-Index | | | FFE-Index | |
| Example Number | Reeled or Converted | HTR-Texture | Brushed | Not Brushed | HTR-Texture | Brushed | Not Brushed |
| 1, | Reeled | 0.14 | 130 | 111 | 0.40 | 47 | 41 |

TABLE XIa-continued

HTR-Texture v. FFE-Index
5 Examples of Present Invention Tissue Paper & Products
Reference FIGS. 48–52

| Example Number | Reeled or Converted | Yankee Side HTR-Texture | Yankee Side FFE-Index Brushed | Yankee Side FFE-Index Not Brushed | Off-Yankee Side HTR-Texture | Off-Yankee Side FFE-Index Brushed | Off-Yankee Side FFE-Index Not Brushed |
|---|---|---|---|---|---|---|---|
| 2 layer | Converted, 2-ply | 0.07 | 124 | 91 | 0.18 | 55 | 31 |
| 2, 2 layer | Reeled | 0.31 | 122 | 106 | 1.33 | 77 | 40 |
| | Converted, 2-ply | 0.31 | 115 | 79 | 1.14 | 60 | 30 |
| 3, 2 layer | Reeled | 0.40 | 168 | 110 | 1.89 | 32 | 14 |
| | Converted, 2-ply | 0.10 | 179 | 128 | 1.03 | 22 | 8 |
| 4, 2 layer | Reeled | 0.06 | 147 | 131 | 0.09 | 135 | 91 |
| | Converted, 1-ply | 0.04 | 154 | 96 | 0.06 | 137 | 89 |
| 5, 2 layer | Reeled | 0.65 | 78 | 52 | 0.95 | 52 | 35 |
| | Converted, 2-ply | 0.30 | 71 | 47 | 0.22 | 53 | 29 |

TABLE XIb

Key: Designator Suffixes
HTR-Texture v. FFE-Index Data Points, FIGS. 48–52

| Designator Suffix, FIGS. 48–52 | Paper: Reeled or Converted | Sample Surface: Yankee Side or Off-Yankee Side | Sample Surface: Brushed or Unbrushed For FFE-Index |
|---|---|---|---|
| -1 | Reeled | Off-Yankee Side | Brushed |
| -2 | Reeled | Off-Yankee Side | Unbrushed |
| -3 | Reeled | Yankee Side | Brushed |
| -4 | Reeled | Yankee Side | Unbrushed |
| -5 | Converted | Off-Yankee Side | Brushed |
| -6 | Converted | Off-Yankee Side | Unbrushed |
| -7 | Converted | Yankee Side | Brushed |
| -8 | Converted | Yankee Side | Unbrushed |

While particular embodiments of the present invention have been illustrated and described, it would be obvious to those skilled in the art that various other changes and modifications can be made without departing from the spirit and scope of the invention. Therefore, it is intended to cover in the appended claims all such changes and modifications that are within the scope of this invention.

What is claimed is:

1. A tissue paper sheet having a substantially flat velutinous top surface, said sheet comprising a first layer comprising papermaking fibers and a second layer comprising substrate means for supporting said first layer and for providing said product with sufficient tensile strength for its intended purpose, said first layer comprising a primary filamentary constituent of about 60% or more by weight of relatively short papermaking fibers having average lengths of from about 0.25 mm to about 1.50 mm, said velutinous top surface being the outwardly facing surface of said first layer which surface is defined by substantially unbonded free end portions of a multiplicity of said short fibers, said sheet having an average top surface human-tactile-response texture (HTR-Texture) of about 1.0 or less, and said velutinous top surface having an average free-fiber-end index (FFE-Index) of at least about sixty (60).

2. The paper sheet of claim 1 wherein said first layer comprises about 85% or more by weight of said primary filamentary constituent.

3. The paper sheet of claim 1 wherein said sheet has an average HTR-Texture of about 0.7 or less.

4. The paper sheet of claim 3 wherein said HTR-Texture is a vestigial remnant of creping.

5. The paper sheet of claim 1 wherein said velutinous top surface has an average FFE-Index of at least about ninety (90).

6. The paper sheet of claim 1 wherein said first layer further comprises a remainder filamentary constituent of relatively long papermaking fiber having average lengths of about 2.0 mm or more.

7. The paper sheet of claim 6 wherein said long papermaking fibers are substantially as flaccid as said short papermaking fibers.

8. The paper sheet of claim 1 wherein said second layer comprises primarily fibrous material.

9. The paper sheet of claim 8 wherein said second layer comprises about 40% or more by weight of relatively long papermaking fibers having average lengths of about 2.0 mm or more.

10. The paper sheet of claim 1 wherein said sheet has a basis weight of from about 6 to about 40 pounds per 3,000 square feet (about 10 to about 65 grams per square meter), and said first layer has a basis weight of from about 3 to about 35 pounds per 3,000 square feet (about 5 to about 57 grams per square meter), said basis weights being as measured in an uncreped state.

11. The paper sheet of claim 10 wherein said sheet has a basis weight of from about 7 to about 25 pounds per 3,000 square feet (about 11 to about 41 grams per square meter), and said first layer has a basis weight of from about 3 to about 20 pounds per 3,000 square feet (about 5 to about 33 grams per square meter), said basis weights being as measured in an uncreped state.

12. The paper sheet of claims 1, 2, 3, 5, 6, 8, or 10 further comprising a third layer comprising papermaking fibers, said third layer being juxtaposed the opposite side of said second layer from said first layer, said third layer comprising a principal filamentary constituent of about 60% or more by weight of relatively short papermaking fibers having average lengths of about 1.5 mm or less, and having a velutinous outside surface, said sheet further having an average HTR-Texture on its third layer side of about 1.0 or less, and said velutinous outside surface having an average FFE-Index of about sixty (60) or more.

13. The paper sheet of claim 12 wherein said third layer is substantially identical to said first layer in composition, average HTR-Texture, and average FEE-Index.

14. The paper sheet of claims 1, 2, 3, 5, 6, 8, or 10 wherein said sheet further comprises a relatively highly bulked and textured third layer of papermaking fibers which third layer is disposed on the opposite side of said second layer from said first layer.

15. The paper sheet of claim 14 wherein said third layer is comprised primarily of relatively short papermaking fibers having average lengths of about 1.5 mm or less, which are partially displaced outwardly from the general plane of said sheet in small discrete deflected areas, said deflected areas numbering from about 15 to about 560 per square cm.

16. A two-ply sheet type tissue paper product having a substantially flat velutinous top surface, said product comprising a first ply of tissue paper and a second ply of tissue paper in juxtaposed relation, said first ply being a two-layer tissue paper sheet comprising a first layer and a second layer, said first layer comprising a primary filamentary constituent of about 60% or more by weight of relatively short papermaking fibers having average lengths of from about 0.25 mm to about 1.5 mm, said velutinous top surface being the outwardly facing surface of said first layer which surface is defined by substantially unbonded free end portions of a multiplicity of said short fibers, said sheet having an average HTR-Texture of about 1.0 or less, and said velutinous surface having an average FFE-Index of at least about sixty (60).

17. The two-ply sheet type tissue paper product of claim 16 wherein said second ply comprises an upper layer of papermaking fibers and a lower layer comprising substrate means for supporting said first layer and for providing said second ply with sufficient tensile strength for its intended purpose, said upper layer comprising a first filamentary constituent of about 60% or more by weight of relatively short papermaking fibers having average lengths of from about 0.25 mm to about 1.5 mm, said upper layer further having an outwardly facing velutinous surface defined by substantially unbonded free end portions of a multiplicity of said short fibers, said second ply having an average upper layer HTR-Texture of about 1.0 or less, and said velutinous surface of said upper layer having an average FFE-Index of about sixty (60) or more, said first and second plies being associated with said second layer of said first ply being juxtaposed said lower layer of said second ply whereby both outwardly facing surfaces of said product are velutinous surfaces.

18. The two-ply sheet type tissue paper product of claim 16 wherein each said ply having a velutinous surface further comprises a relatively highly bulked and textured third layer disposed to face oppositely from each said ply's respective said velutinous surface.

19. The two-ply sheet type tissue paper product of claim 18 wherein said third layer is comprised primarily of relatively short papermaking fibers having average lengths of about 1.5 mm or less which are partially displaced outwardly from the general plane of said sheet in small discrete deflected areas, said deflected areas numbering from about 15 to about 560 per square cm.

20. The two-ply sheet type tissue paper product of claims 16, 17 or 18 further comprising means for providing said product with substantial wet strength whereby said product is adapted to be a facial tissue or a paper towel.

21. The two-ply sheet type tissue paper product of claims 16, 17 or 18 further comprising means for providing said product with relatively low wet strength whereby said product is adapted to be a toilet tissue.

22. A method of making a multi-layer wet-laid tissue paper sheet having a substantially flat and smooth velutinous top surface which velutinous top surface comprises a primary filamentary constituent of about 60% or more by weight of relatively short papermaking fibers having average lengths of about 1.5 mm or less, and which velutinous top surface is characterized by an average free-fiber-end index (FFE-Index) of about 60 or greater and an average humantactile-response texture (HTR-Texture) of about 1.0 or less, said method comprising the steps of:

depositing a first fibrous slurry comprising about 60% or more of said relatively short papermaking fibers onto a first forming surface which is sufficiently smooth to provide a paper web formed thereon from said first slurry with an average HTR-Texture of about 1.0 or less;

depositing a second fibrous slurry onto a second forming surface, said slurry comprising relatively long papermaking fibers as a primary constituent;

dewatering and associating said slurries sufficiently to form a 2-layer embryonic web comprising a first layer and a second layer in juxtaposed relation, and drying said embryonic web without imparting substantial texture thereto whereby said papermaking fibers become bonded together in a relatively smooth unified web, said unified web having a top surface defined primarily by a multiplicity of interfiber-bonded short papermaking fibers from said first slurry; and, breaking sufficient bonds intermediate said multiplicity of short papermaking fibers defining said top surface of said web to provide a predetermined average FFE-Index of about 60 or greater.

23. The method of claim 22 wherein said second forming surface is a relatively smooth foraminous surface of a papermaking machine member, and said first forming surface is the outwardly facing surface of said web layer formed from said second slurry.

24. The method of claim 22 wherein said first forming surface is a relatively smooth foraminous surface of a papermaking machine member, and said second forming surface is the outwardly facing surface of said web layer formed from said first slurry.

25. The method of claim 22, 23, or 24 further comprising the steps of forming a third embryonic layer from a third fibrous slurry comprised primarily of relatively short papermaking fibers having average lengths of about 1.5 mm or less so that the layer formed from said second slurry is sandwiched between the layers formed from said first slurry and said third slurry, and breaking sufficient interfiber bonds intermediate fibers defining the outer surface of said third layer to provide said surface with a predetermined average FFE-Index of at least about 60.

26. The method of claim 22, 23, or 24 further comprising the steps of forming a third embryonic layer from a third fibrous slurry comprised primarily of relatively short papermaking fibers having average lengths of about 1.5 mm or less to form a third embryonic layer so that the layer formed from said second slurry is sandwiched between the layers formed from said first slurry and said third slurry, and dewatering said third embryonic layer with a differential fluid pressure while said third embryonic layer is juxtaposed a carrier member having sufficiently large mesh openings to enable a substantial portion of the short fibers of said third layer to be displaced into said mesh openings to texturize said third layer to an average HTR-Texture of greater than 1.0.

27. A method of making a 3-layer wet-laid tissue paper sheet having a substantially flat and smooth velutinous top surface and a substantially textured bottom surface, said velutinous top surface comprising a primary filamentary constituent of about 60% or more by weight of relatively short papermaking fibers having average lengths of about 1.5 mm or less and which velutinous top surface is characterized by an average free-fiber-end index (FFE-Index) of about 60 or greater and an average human-tactile-response texture (HTR-Texture) of about 1.0 or less, said method comprising the steps of:

wet forming a first embryonic layer of paper having a top surface from a first fibrous slurry comprising about 60% or more of said relatively short papermaking fibers on a first forming surface which is sufficiently smooth to provide a paper web formed thereon from said first slurry with an average HTR-Texture of about 1.0 or less;

wet forming a 2-layer web having a substantially planar long fiber layer having a smooth outer surface and a predominantly short fiber bottom layer having a substantially textured outer surface by deflecting discrete portions of the short fiber layer into the interfilamentary spaces of a foraminous carrier fabric;

associating said first layer with said 2-layer web so that said first layer is juxtaposed said smooth outer surface to form a unified 3-layer embryonic web; and breaking sufficient bonds intermediate said multiplicity of short papermaking fibers defining said top surface of said first layer of said 3-layer web to provide said top surface with a predetermined average FFE-Index of about 60 or greater.

28. The method of claim 22, 23, 24, or 27 wherein said breaking of sufficient bonds is enabled by adhering said web to a creping surface and effected by creping said web from said creping surface at a fiber consistency of about 80% or more, and said method further comprises the step of calendering and drawing said web sufficiently to assure an average top surface HTR-Texture of about 1.0 or less.

29. The method of claim 28 wherein said creping is effected at a fiber consistency of about 95% or more.

30. The method of claim 28 wherein said creping is effected to a sufficient degree to impart an average HTR-Texture to said top surface of said web of greater than 1.0, and an average FFE-Index to said top surface of about 90 or more.

31. The method of claim 28 wherein said top surface of said web is the surface of said web which is adhered to said creping surface.

* * * * *